US008548180B2

(12) United States Patent
Takagi et al.

(10) Patent No.: US 8,548,180 B2
(45) Date of Patent: Oct. 1, 2013

(54) SYSTEM, METHOD, PROGRAM, AND INTEGRATED CIRCUIT FOR HEARING AID

(75) Inventors: Yoshiaki Takagi, Kanagawa (JP); Gempo Ito, Kanagawa (JP); Eiji Noguchi, Osaka (JP); Takashi Katayama, Ehime (JP)

(73) Assignee: Panasonic Corporation, Osaka (JP)

( * ) Notice: Subject to any disclaimer, the term of this patent is extended or adjusted under 35 U.S.C. 154(b) by 303 days.

(21) Appl. No.: 13/146,110

(22) PCT Filed: Nov. 9, 2010

(86) PCT No.: PCT/JP2010/006553
§ 371 (c)(1),
(2), (4) Date: Jul. 25, 2011

(87) PCT Pub. No.: WO2011/064950
PCT Pub. Date: Jun. 3, 2011

(65) Prior Publication Data

US 2011/0280424 A1 Nov. 17, 2011

(30) Foreign Application Priority Data

Nov. 25, 2009 (JP) ..... 2009-267108

(51) Int. Cl.
*H04R 25/00* (2006.01)

(52) U.S. Cl.
USPC ..... 381/317; 381/312; 381/315

(58) Field of Classification Search
USPC ..... 381/312–313, 315–318, 320–321
See application file for complete search history.

(56) References Cited

U.S. PATENT DOCUMENTS

| | | | |
|---|---|---|---|
| 6,674,868 | B1 | 1/2004 | Narusawa |
| 2004/0032963 | A1 | 2/2004 | Narusawa |
| 2004/0161128 | A1 | 8/2004 | Narusawa |
| 2010/0046777 | A1 | 2/2010 | Ito et al. |
| 2010/0254554 | A1 | 10/2010 | Fusakawa et al. |

FOREIGN PATENT DOCUMENTS

| | | |
|---|---|---|
| JP | 2001-157299 | 6/2001 |
| JP | 2005-268964 | 9/2005 |
| WO | 2009/087968 | 7/2009 |
| WO | 2009/125579 | 10/2009 |

OTHER PUBLICATIONS

International Search Report issued Dec. 7, 2010 in International (PCT) Application No. PCT/JP2010/006553.

(Continued)

*Primary Examiner* — Suhan Ni
(74) *Attorney, Agent, or Firm* — Wenderoth, Lind & Ponack, LLP

(57) ABSTRACT

To provide a hearing aid system (1000) performing dichotic-listening binaural hearing aid processing which improves the clarity of speech and maintains the spatial perception ability. Each of first and second hearing aid devices (1100, 1200) includes a sound pickup unit (1110, 1210) and an output unit (1120, 1220) outputting a sound indicated by a suppressed acoustic signal. The hearing aid system (1000) includes: a first band suppression unit (1300) generating the suppressed acoustic signal indicating the sound outputted from the output unit (1120), by suppressing a signal in a first suppression-target band out of the acoustic signal outputted from the sound pickup unit (1110); and a second band suppression unit (1400) generating the suppressed acoustic signal indicating the sound outputted from the output unit (1220), by suppressing a signal in a second suppression-target band out of the acoustic signal outputted from the sound pickup unit (1210). The suppressed acoustic signals indicating the sounds outputted respectively from the output units (1120, 1220) include, in common, a signal in a non-voice band included in the acoustic signal.

14 Claims, 22 Drawing Sheets

(56) References Cited

OTHER PUBLICATIONS

Barbara Franklin, "*The Effect of Combining low—and high-frequency passbands on consonant recognition in the hearing impaired*", Journal of Speech and Hearing Research, p. 719-727, Jun. 1975.

D.S. Chaudhari and P.C. Pandey, "*Dichotic Presentation of Speech Signal Using Critical Filter Bank for Bilateral Sensorineural Hearing Impairment*", Proc. 16$^{th}$ ICA, Jun. 1998.

SYSTEM, METHOD, PROGRAM, AND INTEGRATED CIRCUIT FOR HEARING AID

TECHNICAL FIELD

The present invention relates to a hearing aid system including two hearing aid devices to aid in hearing.

BACKGROUND ART

Firstly, acoustic characteristics of speech are described.

FIG. 1A shows a diagram showing a frequency spectrum of speech. In FIG. 1A, the horizontal axis represents frequency and the vertical axis represents amplitude. A solid line 501 in FIG. 1A shows an example of speech represented by a frequency spectrum. A speech frequency spectrum has several peaks on the frequency axis. The peak of the lowest frequency indicates a fundamental speech frequency called a pitch, and is different depending on the tone of voice. In general, the peak of the lowest frequency is between 125 Hz and 300 Hz. Voice is a result of resonance (vibration) of a sound wave generated by vocal cord vibration, in the vocal tract which is a path from the pharynx to the lips. The resonance frequency is called a formant. The formant with the lowest frequency is called a first formant, the formant with the second lowest frequency is called a second formant, and so on. To be more specific, in FIG. 1A, the first peak of the lowest frequency indicates the pitch (i.e., the pitch frequency), the second peak indicates the first formant (i.e., the first formant frequency), and the third peak indicates the second formant (i.e., the second formant frequency). Generally speaking, although depending on the gender of an utterer and on uttered speech, the first formant frequency is in a range from 200 Hz to 1200 Hz and the second formant frequency is in a range from 800 Hz to 3000 Hz.

It is said that humans distinguish between vowels by a combination of the first and second formant frequencies. Although a consonant is identified mainly based on a change pattern in the beginning of speech on the time axis of the first and second formant frequencies, it is said that some consonants are identified from a spectrum shape pattern at a frequency higher than the second formant frequency.

In the field of auditory psychology, auditory masking occurs by which a sound is hard to hear because the sound is affected by a specific another sound. Auditory masking includes frequency masking and temporal masking. The frequency masking occurs when a large sound with a specific frequency component masks a sound with a frequency which is close to the specific frequency component and thus makes it difficult to perceive the sound at the close frequency. The temporal masking occurs when a preceding sound masks a subsequent sound and thus makes it difficult to perceive the subsequent sound.

The frequency masking is explained with reference to FIG. 1A. A dashed line 502 in FIG. 1A indicates a masking curve of the first formant component of speech. A listener cannot perceive a sound whose amplitude is lower than the dashed line 502. The masking curve varies from individual to individual, and a frequency width to be influenced by the masking curve also varies among the individuals. In the example shown in FIG. 1A, the first formant component masks the second formant component. In the case of a typical sound, the pitch component and the first formant component tend to be greater in power while the other components tend to be relatively smaller in power. On this account, when the first formant component masks the sounds in the nearby frequency bands as in the example shown in FIG. 1A, there is a possibility that vowels may be misheard.

Next, the temporal masking is explained with reference to FIG. 1B.

FIG. 1B is a diagram showing a temporal waveform of speech. In FIG. 1B, the horizontal axis represents time and the vertical axis represents amplitude. A solid line indicates a temporal waveform of speech uttered as "usa". From the left side of FIG. 1B, parts corresponding to a vowel "u", a consonant "s", and a vowel "a" (i.e., partial speech) are temporally illustrated in this order. In the example shown in FIG. 1B, a dashed line indicates a time domain of temporal masking by the preceding vowel "u" which masks the subsequent consonant "s". The temporal masking varies from individual to individual, and a width of the time domain influenced by this temporal masking also varies among the individuals. In the case of a typical sound, a vowel tends to be greater in power while a consonant tends to be relatively smaller in power. On this account, when the preceding vowel masks the subsequent consonant as in the example shown in FIG. 1B, there is a possibility that the consonant may be misheard or inaudible.

With the emergence of an aging society, the number of people with hearing loss is growing. As symptoms of hearing loss, decreases in hearing, in frequency resolution (frequency selection), and in temporal resolution are known. Due to a decrease in hearing, it is harder to perceive a soft sound as compared to a person with normal hearing. Due to a decrease in frequency resolution, the frequency band affected by the frequency masking is wider as compared to the case of a person with normal hearing. Thus, a person with hearing loss is likely to misidentify a vowel. Due to a decrease in temporal resolution, the length of time affected by the temporal masking is longer as compared to the case of a person with normal hearing. Thus, it is harder for a person with hearing loss to perceive a subsequent consonant.

Conventionally, hearing aid processing for simply amplifying the amount of sound has been performed to improve the hearing. In order to improve the frequency resolution and the temporal resolution, hearing aid processing called "dichotic-listening binaural hearing aid" has been proposed to reduce the influence of the hearing masking (see Non Patent Literatures 1 and 2, for example). By this processing, an acoustic signal (a signal indicating a sound including speech) is divided on the frequency axis, and different signal characteristics of the divided acoustic signals are presented to the right and left ears, respectively, so that these signals are perceived as one sound in the brain. The dichotic-listening binaural hearing aid processing has been reported to increase the clarity of speech.

It is thought that the dichotic-listening binaural hearing aid processing increases the clarity of speech by presenting an acoustic signal in the masking frequency band (or an acoustic signal in the masking time domain) and an acoustic signal in the masked frequency band (or an acoustic signal in the masked time domain) to different ears, respectively, to make the masked speech perceivable.

FIGS. 2A and 2B are diagrams each showing a frequency spectrum of speech on which the dichotic-listening binaural hearing aid processing has been performed. In FIGS. 2A and 2B, the horizontal axis represents frequency and the vertical axis represents amplitude as in FIG. 1A.

As shown in FIG. 2A, speech which can be heard by one ear as a result of the dichotic-listening binaural hearing aid processing is only speech in a low frequency band. Also, as shown in FIG. 2B, speech which can be heard by the other ear as a result of the dichotic-listening binaural hearing aid processing is only speech in a high frequency band. Therefore, the speech in the second formant frequency can be prevented from being masked (by the frequency masking) by the speech in the first formant frequency.

FIGS. 3A and 3B are diagrams each showing a temporal waveform of speech on which the dichotic-listening binaural hearing aid processing has been performed. In FIGS. 3A and 3B, the horizontal axis represents time and the vertical axis represents amplitude as in FIG. 1B.

As shown in FIG. 3A, speech which can be heard by one ear as a result of the dichotic-listening binaural hearing aid processing is only speech in a low frequency band, that is, only the vowels "u" and "a". Also, as shown in FIG. 3B, speech which can be heard by the other ear as a result of the dichotic-listening binaural hearing aid processing is only speech in a high frequency band, that is, only the consonant "s". Therefore, the consonant "s" can be prevented from being masked (by the temporal masking) by the vowel "u".

CITATION LIST

Non Patent Literature

[NPL 1]
Barbara Franklin, "The Effect of Combining Low- and High-frequency Passbands on Consonant Recognition in the Hearing Impaired", (the U.S.A.), Journal of Speech and Hearing Research, 1975

[NPL 2]
D. S. Chaudhari and P. C. Pandey, "Dichotic Presentation of Speech Signal Using Critical Filter Bank for Bilateral Sensorineural Hearing Impairment", (the U.S.A.), Proc. 16th ICA, 1998

SUMMARY OF INVENTION

Technical Problem

However, the stated conventional dichotic-listening binaural hearing aid processing has a problem of interfering the spatial perception of sound. To be more specific, although the conventional dichotic-listening binaural hearing aid processing can increase the clarity of speech as a result of separate speech perceptions by both ears, a stereophonic sound by listening with both ears cannot be provided. For this reason, a user of the dichotic-listening binaural hearing aid feels, for example, that all the sounds are heard from the front direction, meaning that the user cannot spatially perceive the sound. There is a possibility that the problem that the user cannot perceive the spatiality of sound may lead to another problem that the user ends up being exhausted by the unnaturalness of sound or misperceiving a direction from which an alarm sound, such as a bicycle bell sound, is approaching.

The stated problem is explained in detail, with reference to FIGS. 4, 5A to 5C, and 6.

FIG. 4 is a diagram showing an arrangement of sounds with respect to a listener.

As shown in FIG. 4, for example, sound sources 602 to 605 are present around a listener 601 wearing a hearing aid system which employs the aforementioned conventional dichotic-listening binaural hearing aid. To be more specific, a sound source 602 of speech which the listener 601 wishes to hear is present in front of the listener 601. Moreover, a sound source 603 of an ambient noise L is present on the left of the listener 601, and a sound source 604 of an ambient noise R is present on the right of the listener 601. Furthermore, a sound source 605 of an alarm sound is approaching the listener 601.

FIGS. 5A to 5C are diagrams showing frequency spectra of the sounds of the sound sources 602 to 605.

More specifically, FIG. 5A is a diagram showing a frequency spectrum of desired speech "a" of the sound source 602. In general, the pitch is in the frequency band from 125 Hz to 300 Hz. In the example shown in FIG. 5A, the pitch of the speech is around 200 Hz. Also, the first formant is around 700 Hz and the second formant is around 1600 Hz. Thus, the main speech components are included in a range from 200 Hz to 1600 Hz on the whole. FIG. 5B is a diagram showing a frequency spectrum of the ambient noises L and R of the sound sources 603 and 604. The frequency spectrum of the ambient noises L and R is identical to a long-time average spectrum of typical traffic noise, and thus the noise level tends to gradually decrease from lower frequencies towards higher frequencies. FIG. 5C is a diagram showing a frequency spectrum of a bicycle bell sound which is the alarm sound of the sound source 605. The level of harmonic components increases towards higher frequencies from the fundamental frequency of 2500 Hz, and thus the high frequency components are dominant.

FIG. 6 is a diagram explaining the problem caused by the stated conventional dichotic-listening binaural hearing aid.

In the case of the ambient environment shown in FIG. 4, it is preferable that a crossover frequency to be a boundary for dividing the sound between higher frequencies and lower frequencies in the dichotic-listening binaural hearing aid processing should be, for example, 1250 Hz which is higher than the first formant of the desired speech of the sound source 602 and lower than the second formant of the speech.

However, when the dichotic-listening binaural hearing aid processing is performed in this way, the desired speech of the sound source 602 and the ambient noises L and R of the sound sources 603 and 604 are perceived as if these sounds were all from the front direction of the listener 601 or these sounds were present in the head of the listener 601. As a result, the user of the hearing aid system which employs the conventional dichotic-listening binaural hearing aid feels that all the sounds are heard from the same direction. Also, since the alarm sound of the sound source 605 is heard only from the side to which the high frequency sounds are presented, the user may misperceive the actual direction of the alarm sound of the sound source 605. On account of this, the clarity of speech needs to be improved while maintaining the ability of the user to spatially perceive the ambient sounds.

The present invention is conceived in view of the stated problem, and has an object to provide a hearing aid system and a hearing aid method capable of performing the dichotic-listening binaural hearing aid processing that improves the clarity of speech while maintaining the spatial perception ability.

Solution to Problem

In order to achieve the aforementioned object, the hearing aid system in an aspect of the present invention is a hearing aid system including a first hearing aid device and a second hearing aid device, each of the first hearing aid device and the second hearing aid device including: a sound pickup unit which picks up a sound and outputs an acoustic signal indicating the picked-up sound; and an output unit which outputs a sound indicated by a suppressed acoustic signal generated by suppression performed on a signal in a certain frequency band out of frequency bands of the sound indicted by the acoustic signal, the frequency bands of the sound indicated by the acoustic signal including: a voice band which is a frequency band having a vocal component; and a non-voice band other than the voice band, the voice band including a first suppression-target band and a second suppression-target band which are frequency bands different from each other, the hearing aid system including: a first band suppression unit which generates the suppressed acoustic signal indicating the sound outputted from the output unit of the first hearing aid device, by suppressing a signal in the first suppression-target band out of the acoustic signal outputted from the sound pickup unit of the first hearing aid device; and a second band suppression unit which generates the suppressed acoustic signal indicating the sound outputted from the output unit of the second hearing aid device, by suppressing a signal in the second suppression-target band out of the acoustic signal outputted from the sound pickup unit of the second hearing aid device, wherein the suppressed acoustic signals indicating the sounds outputted respectively from the output units of the first hearing aid device and the second hearing aid device include, in common, a signal in the non-voice band included in the acoustic signal.

With this configuration, since the signal in the first suppression-target band included in the voice band is suppressed out of the acoustic signal, the first hearing aid device outputs the sound in the second suppression-target band included in the voice band and the sound in the non-voice band. On the other hand, since the signal in the second suppression-target band included in the voice band is suppressed out of the acoustic signal, the second hearing aid device outputs the sound in the first suppression-target band included in the voice band and the sound in the non-voice band. Accordingly; the sounds in different frequency bands in the voice band including many speech components are outputted respectively from the first and second hearing aid devices. In other words, the dichotic-listening binaural hearing aid processing is performed, so that the clarity of speech can be improved. Moreover, the sound in the common frequency band in the non-voice band other that the voice band is outputted from both the first and second hearing aid devices. Thus, the user can hear the sound, such as noise, in stereo. As a result, the dichotic-listening binaural hearing aid processing can improve the clarity of speech while maintaining the spatial perception ability.

Also, the first band suppression unit includes: a first division unit which divides the acoustic signal outputted from the sound pickup unit of the first hearing aid device into a signal in the voice band and the signal in the non-voice band; a first suppression unit which suppresses the signal in the first suppression-target band, out of the signal in the voice band generated by the division performed by the first division unit; and a first mixing unit which generates the suppressed acoustic signal indicating the sound outputted from the output unit of the first hearing aid device, by mixing the signal in the voice band suppressed by the first suppression unit and the signal in the non-voice band, and the second band suppression unit includes: a second division unit which divides the acoustic signal outputted from the sound pickup unit of the second hearing aid device into a signal in the voice band and the signal in the non-voice band; a second suppression unit which suppresses the signal in the second suppression-target band, out of the signal in the voice band generated by the division performed by the second division unit; and a second mixing unit which generates the suppressed acoustic signal indicating the sound outputted from the output unit of the second hearing aid device, by mixing the signal in the voice band suppressed by the second suppression unit and the signal in the non-voice band.

With this configuration, the acoustic signal is divided into a signal in the voice band and the signal in the non-voice band. Thus, the processing can be performed on the signal in the voice band separately from the signal in the non-voice band. Therefore, the hearing aid processing can be performed easily and appropriately.

Moreover, the first division unit divides the acoustic signal outputted from the sound pickup unit of the first hearing aid device into: a signal in a low non-voice band which is lower in frequency than the voice band and which is included in the non-voice band; the signal in the voice band; and a signal in a high non-voice band which is higher in frequency than the voice band and which is included in the non-voice band, and the first mixing unit mixes the signal in the voice band suppressed by the first suppression unit, the signal in the low non-voice band, and the signal in the high non-voice band.

With this, the signal in the non-voice band is divided into the signal in the low non-voice band which is lower than the voice band and the signal in the high non-voice band which is higher than the voice band. This allows the user to hear, in stereo, the noise or alarm sound present in the band lower or higher than the voice band.

Furthermore, an upper limit frequency in the low non-voice band is 200 Hz or higher, and lower than 2500 Hz, a lower limit frequency in the high non-voice band is 2500 Hz or higher, and a boundary frequency between the first suppression-target band and the second suppression-target band is present between the upper limit frequency and the lower limit frequency.

With this, the voice band and the non-voice band can be appropriately distinguished. As a result, the dichotic-listening binaural hearing aid processing can be appropriately performed on the sound including more speech components. This allows the user to hear, in stereo, the sound in a lower or higher frequency band including less speech components.

Also, the boundary frequency is higher than a first formant frequency of speech indicated by the acoustic signal outputted from the sound pickup unit and lower than a second formant frequency of the speech, the upper limit frequency is lower than the first formant frequency, and the lower limit frequency is higher than the second formant frequency.

With this, since the first formant frequency is in one of the first and second suppression-target bands included in the voice band and the second formant frequency is in the other, the sound of the first formant and the sound of the second formant can be presented to the right and left ears, respectively. Thus, for the user impaired in the frequency resolution or in the temporal resolution, the influence of the hearing masking can be suppressed and the clarity of speech can be improved. Moreover, the user can hear, in stereo, the sound in the frequency band having less influence over the clarity of speech.

Moreover, the first hearing aid device further includes: a formant calculation unit which calculates each of the first formant frequency and the second formant frequency, based on the acoustic signal outputted from the sound pickup unit of the first hearing aid device; and a suppression control unit which sets the upper limit frequency, the lower limit frequency, and the boundary frequency for each of the first division unit and the first suppression unit, based on the first formant frequency and the second formant frequency calculated by the formant calculation unit.

With this, the first and second formant frequencies are calculated on the basis of the acoustic signal. Then, according to these frequencies, the low non-voice band, the first and second suppression-target bands, and the high non-voice band are set. In other words, these frequency bands can be set dynamically and appropriately according to speech actually picked up, and thus the clarity can be improved for any kind of speech.

Furthermore, the first division unit includes: a band-pass filter which separates the signal in the voice band from the acoustic signal, by passing only the signal in the voice band out of the acoustic signal outputted from the sound pickup unit of the first hearing aid device; and a subtraction unit which separates the signal in the non-voice band from the acoustic signal, by subtracting the signal in the voice band from the acoustic signal.

With this, the signal in the non-voice band is separated as a result of a subtraction of the signal in the voice band from the acoustic signal. Therefore, only the voice band may be set in the first division unit, that is, the non-voice band does not need to be set in the first division unit. This can save the effort of setting the frequency bands.

Also, the first division unit divides the acoustic signal outputted from the sound pickup unit of the first hearing aid device into: the signal in the low non-voice band which is lower in frequency than the voice band and which is included in the non-voice band; the signal in the first suppression-target band; the signal in the second suppression-target band; and the signal in the high non-voice band which is higher in frequency than the voice band and which is included in the non-voice band, and the first mixing unit mixes the signal in the low non-voice band, the signal in the first suppression-target band suppressed by the first suppression unit, the signal in the second suppression-target band, and the signal in the high non-voice band.

With this, the acoustic signal is divided into the signal in the low non-voice band, the signal in the first suppression-target band, the signal in the second suppression-target band, and the signal in the high non-voice band. Thus, the signal processing can be performed for each of these frequency bands, and convenience of the signal processing can be enhanced.

Moreover, the first division unit divides the acoustic signal outputted from the sound pickup unit of the first hearing aid device into: the signal in the first suppression-target band; the signal in the second suppression-target band; and the signal in the non-voice band which is higher in frequency than the voice band, and the first mixing unit mixes the signal in the first suppression-target band suppressed by the first suppression unit, the signal in the second suppression-target band, and the signal in the non-voice band.

With this, the user can hear, in stereo, the sound in the frequency band higher than the voice band. As a result, the user can appropriately perceive the spatial location of a sound source of, for example, an alarm sound.

Furthermore, the hearing aid system further includes an operation receiving unit which receives an operation performed to switch a hearing aid mode between a first hearing aid mode and a second hearing aid mode, wherein, when the operation receiving unit receives the operation to switch the hearing aid mode to the first hearing aid mode, the first and second band suppression units generate the suppressed acoustic signals indicating the sounds outputted from the output units of the first and second hearing aid devices, respectively, and when the operation receiving unit receives the operation to switch the hearing aid mode to the second hearing aid mode, the first and second band suppression units do not suppress the acoustic signals and the output units of the first and second hearing aid devices output the sounds indicated by the acoustic signals which is not suppressed by the first and second band suppression units, respectively.

With this, when listening to speech, the user performs an operation of switching the mode to the first hearing mode (the dichotic-listening binaural hearing aid mode). Accordingly, the dichotic-listening binaural hearing aid processing can improve the clarity of speech while maintaining the spatial perception ability. When not listening to speech, the user performs an operation of switching the mode to the second hearing mode (the normal hearing aid mode). Accordingly, the user can hear the sounds in all the frequency bands in stereo. As a result, the convenience of the user can be enhanced.

Also, when receiving the operation, the operation receiving unit sends, to each of the first and second hearing aid devices, a mode switching command indicating the operation. The first hearing aid device includes: the first band suppression unit; a first command sending-receiving unit which receives the mode switching command; and a first suppression control unit which controls the first band suppression unit according to the mode switching command received by the first command sending-receiving unit, and the second hearing aid device includes: the second band suppression unit; a second command sending-receiving unit which receives the mode switching command; and a second suppression control unit which controls the second band suppression unit according to the mode switching command received by the second command sending-receiving unit.

With this, via the communication established between the operation receiving unit and the first and second hearing aid devices, the hearing aid mode can be switched between the first hearing aid mode and the second hearing aid mode. Thus, using the operation receiving unit as a remote control, the user can switch the hearing aid modes of the first and second hearing aid devices by remote control.

Moreover, when receiving the operation, the operation receiving unit sends a mode-switching verification command to each of the first and second hearing aid devices and sends the mode switching command to each of the first and second hearing aid devices only when receiving an acknowledgment signal from each of the first and second hearing aid devices in response to the sent mode-switching verification command, and when receiving the mode-switching verification command, each of the first and second command sending-receiving units sends the acknowledgment signal.

With this, when establishing wireless communication with the first and second hearing aid devices, the operation receiving unit verifies whether a command is normally received by the first and second hearing aid devices by sending a mode-switching verification command and by receiving an acknowledgment signal. After this, the operation receiving unit can send a mode switching command. This can prevent a case where only one of the first and second hearing aid devices switches the hearing aid mode according to the mode switching command and the hearing aid modes of the first and second hearing aid devices are different from each other.

It should be noted that the present invention can be implemented not only as such a hearing aid system, but also as a hearing aid method executed by the hearing aid system, a computer program causing a computer to execute hearing aid processing of the hearing aid system, a recording medium storing the computer program, and an integrated circuit executing the hearing aid processing.

Advantageous Effects of Invention

The hearing aid system and the hearing aid method according to the present invention enables the user to spatially perceive an environmental sound (i.e., an ambient sound) and can also improve the clarity of speech.

DESCRIPTION OF EMBODIMENTS

The following is a description of embodiments according to the present invention, with reference to the drawings.

Figure 7:
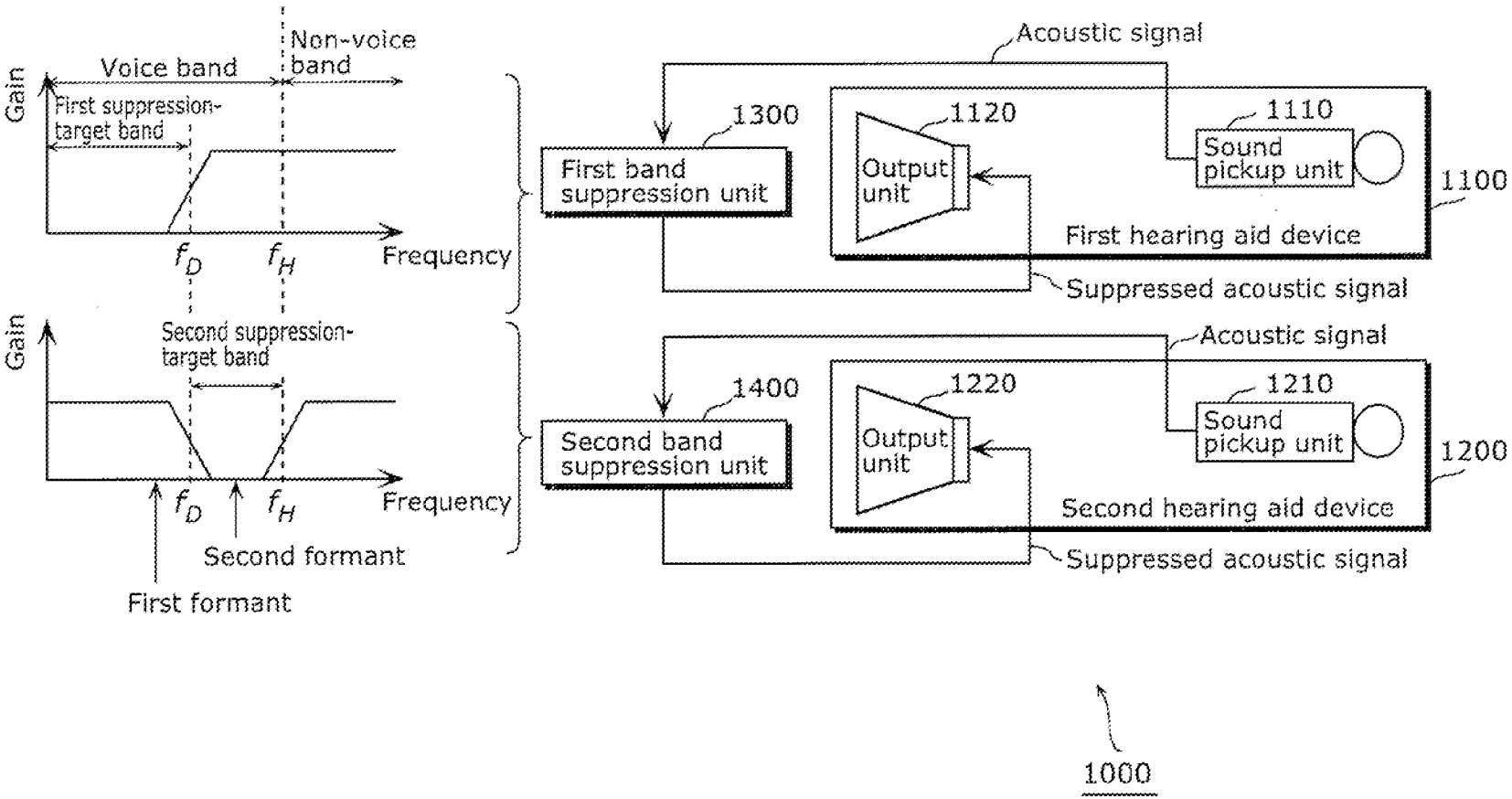
FIG. 7 is a block diagram showing a schematic configuration of a hearing aid system in an embodiment according to the present invention.

FIG. 7 is a block diagram showing a schematic configuration of a hearing aid system in an embodiment according to the present invention.

A hearing aid system 1000 includes first and second hearing aid devices 1100 and 1200. The first hearing aid device 1100 includes a sound pickup unit 1110 and an output unit 1120. The second hearing aid device 1200 includes a sound pickup unit 1210 and an output unit 1220. Each of the sound pickup units 1110 and 1210 picks up a sound and outputs an acoustic signal indicating the picked-up sound. Each of the output units 1120 and 1120 outputs a sound indicated by a suppressed acoustic signal generated as a result of suppression performed on a signal in a certain frequency band out of frequency bands of the aforementioned acoustic signal. Here, the frequency bands of the sound indicated by the acoustic signal include: a voice band which is a frequency band having a speech component; and a non-voice band which is other than the voice band. The voice band includes first and second suppression-target bands which are frequency bands different from each other.

The hearing aid system 1000 includes first and second band suppression units 1300 and 1400. The first band suppression unit 1300 generates the suppressed acoustic signal indicating the sound outputted from the output unit 1120 of the first hearing aid device 1100, by suppressing a signal in the first suppression-target band out of the acoustic signal outputted from the sound pickup unit 1110 of the first hearing aid device 1100. The second band suppression unit 1400 generates the suppressed acoustic signal indicating the sound outputted from the output unit 1220 of the second hearing aid device 1200, by suppressing a signal in the second suppression-target band out of the acoustic signal outputted from the sound pickup unit 1210 of the second hearing aid device 1200. Here, the suppressed acoustic signals indicating the sounds respectively outputted from the output units 1120 and 1220 of the first and second hearing aid devices 1100 and 1200 include, in common, a signal in the non-voice band included in the acoustic signal. It is preferable that the first suppression-target band include the first formant of speech and the second suppression-target band include the second formant of speech.

With this configuration, since the signal in the first suppression-target band included in the voice band is suppressed out of the acoustic signal, the first hearing aid device 1100 outputs the sound in the second suppression-target band included in the voice band and the sound in the non-voice band. On the other hand, since the signal in the second suppression-target band included in the voice band is suppressed out of the acoustic signal, the second hearing aid device 1200 outputs the sound in the first suppression-target band included in the voice band and the sound in the non-voice band. Accordingly, the sounds in different frequency bands in the voice band including many speech components are outputted respectively from the first and second hearing aid devices 1100 and 1200. In other words, the dichotic-listening binaural hearing aid processing is performed, so that the clarity of speech can be improved. Moreover, the sound in the common frequency band in the non-voice band other that the voice band is outputted from both the first and second hearing aid devices 1100 and 1200. Thus, the user can hear the sound, such as noise, in stereo. As a result, the dichotic-listening binaural hearing aid processing can improve the clarity of speech while maintaining the spatial perception ability.

Specific embodiments of the present invention are described as follows.

Embodiment 1

Figure 8:
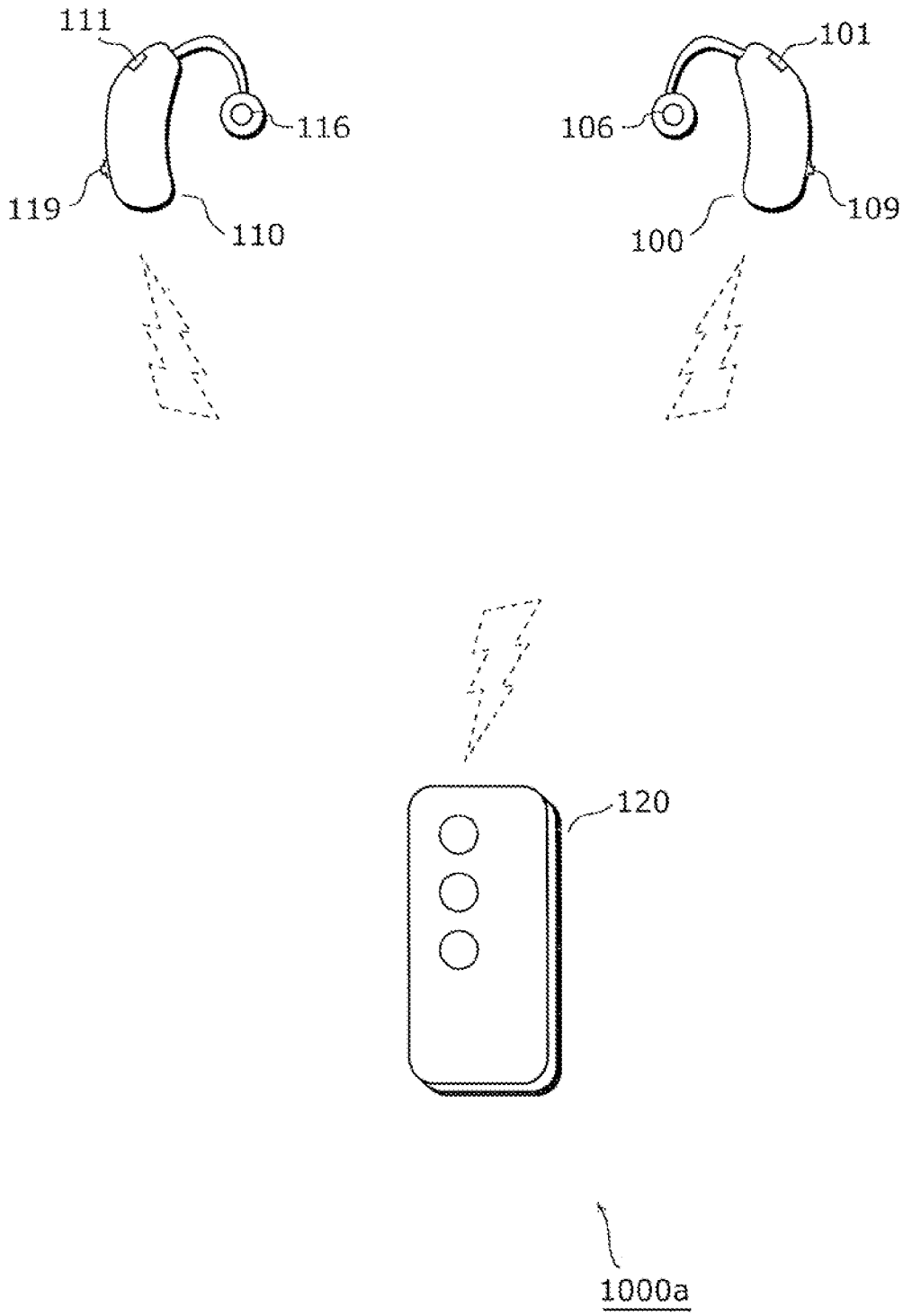
FIG. 8 is a diagram showing an external view of the hearing aid system in a first embodiment according to the present invention.

FIG. 8 is a diagram showing an external view of the hearing aid system in the first embodiment according to the present invention.

A hearing aid system 1000*a* includes: first and second hearing aid devices 100 and 110 which are to be fitted on the left and right ears, respectively; and a remote control 120. It should be noted that the hearing aid system 1000*a* corresponds to the hearing aid system 1000 shown in FIG. 7, and that the first and second hearing aid devices 100 and 110 correspond to the first and second hearing aid devices 1100 and 1200, respectively, shown in FIG. 7.

The first hearing aid device 100 is fitted on, for example, the left ear, and includes: a main unit which performs amplification to compensate hearing loss; a sound pickup unit 101 included in the main unit; an output unit 106; and a switch 109. The second hearing aid device 110 has the same configuration as the first hearing aid device 100, and is fitted on, for example, the right ear. More specifically, the second hearing aid device 110 includes: a main unit which performs amplification to compensate hearing loss; a sound pickup unit 111 included in the main unit; an output unit 116; and a switch 119.

The sound pickup units 101 and 111 correspond to the sound pickup units 1110 and 1210, respectively, shown in FIG. 7. Each of the sound pickup units 101 and 111 is configured with, for example, a microphone. The output units 106 and 116 correspond to the output units 1120 and 1220, respectively, shown in FIG. 7. Each of the output units 106 and 116 is configured with, for example, an earphone (a receiver).

Each of the switches 109 and 119 switches between hearing aid modes. The hearing aid modes includes at least a dichotic-listening binaural hearing aid mode in the present embodiment of the present invention and a normal hearing aid mode. When the mode is switched to the normal hearing aid mode, the hearing aid system 1000*a* does not perform the dichotic-listening binaural hearing aid processing, so that a user (i.e., a listener) of the hearing aid system 1000*a* hears ambient sounds in stereo. To be more specific, the first hearing aid device 100 fitted on the left ear performs hearing aid processing (i.e., amplification processing) on the sound picked up by the sound pickup unit 101 included in the first hearing aid device 100, and then presents the sound to the left ear via the output unit 106. Also, the second hearing aid device 110 fitted on the right ear performs hearing aid processing (i.e., amplification processing) on the sound picked up by the sound pickup unit 111 included in the second hearing aid device 110, and then presents the sound to the right ear via the output unit 116. As a result, the user hears the ambient sounds in stereo. When hearing a sound in stereo, the user can perceive the direction from which the sound is heard. On the other hand, when the mode is switched to the dichotic-listening binaural hearing aid mode, the hearing aid system 1000*a* performs the dichotic-listening binaural hearing aid processing according to the present invention. This processing is described later.

The remote control 120 includes operation buttons, and receives an operation from the user. According to the received operation, the remote control 120 controls the hearing aid processing performed by the first hearing aid device 100 and the second hearing aid device 110. In the present embodiment, the remote control 120 controls the first and second hearing aid devices 100 and 110 by establishing wireless communication with the first and second hearing aid devices 100 and 110. For example, the remote control 120 adjusts amplification factors of the first and second hearing aid devices 100 and 110, and switches between the aforementioned hearing aid modes. When wishing to particularly clearly hear the voice of a person with whom the user is having a conversation for example, the user performs this switching to enable the first and second hearing aid devices 100 and 110 to operate in the is dichotic-listening binaural hearing aid mode. As a result, the voice can be heard more clearly.

Note that the switching between the modes can be performed using the switch 109, 119, or the remote control 120. Thus, in the present embodiment, an operation receiving unit is configured with at least one of the switches 109 and 119 and the remote control 120. Also note that the remote control 120 is not an essential component and that the hearing aid system according to the present invention may include only the first and second hearing aid devices 100 and 110.

Next, a detailed configuration of the hearing aid system 1000*a* in the first embodiment is described.

Figure 9:
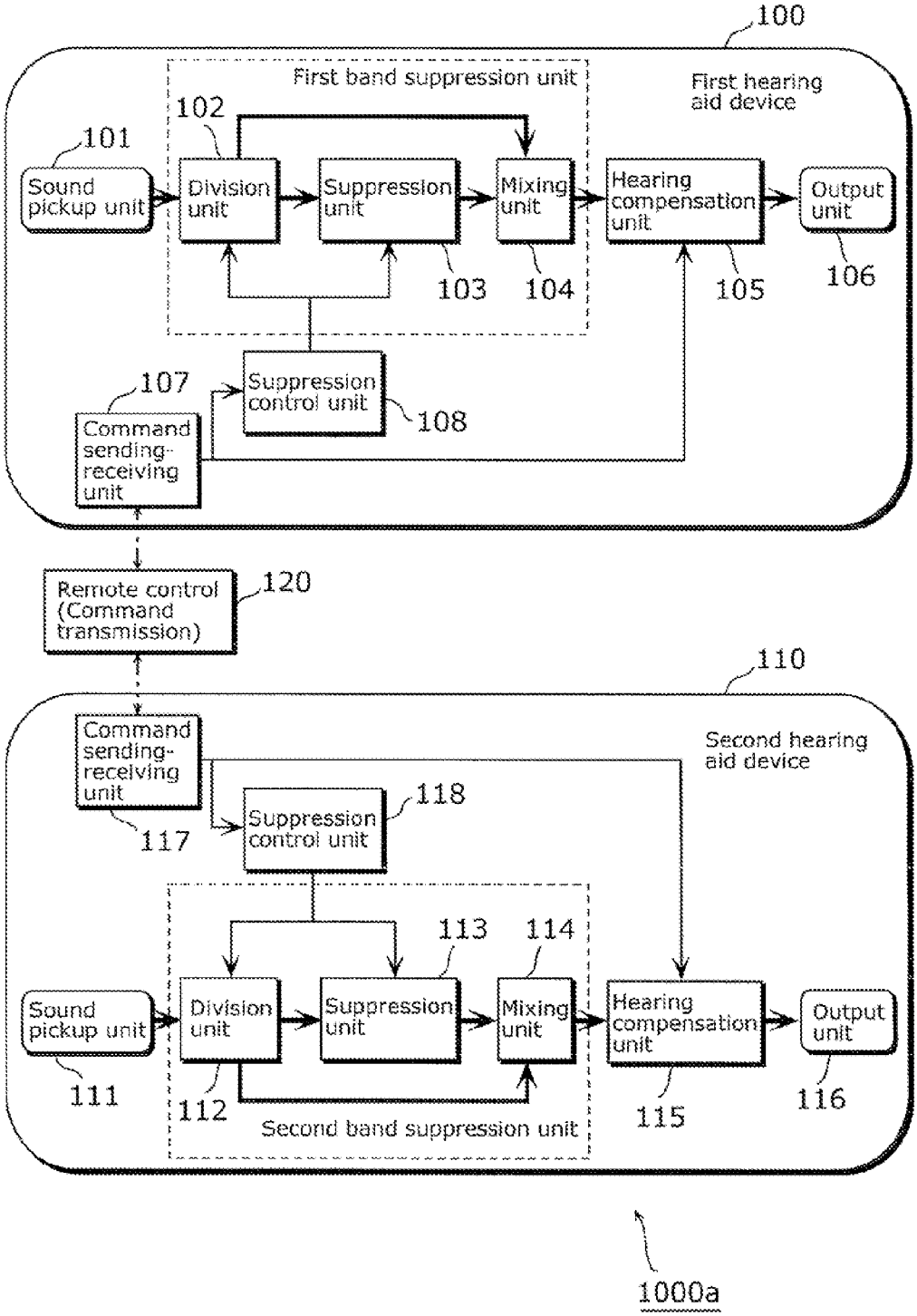
FIG. 9 is a functional block diagram of the hearing aid system in the first embodiment according to the present invention.

FIG. 9 is a functional block diagram of the hearing aid system 1000*a* in the first embodiment according to the present invention.

The first hearing aid device 100 includes the sound pickup unit 101, a division unit 102, a suppression unit 103, a mixing unit 104, a hearing compensation unit 105, the output unit 106, a command sending-receiving unit 107, and a suppression control unit 108. The sound pickup unit 101 picks up a sound and outputs an acoustic signal generated from the picked-up sound.

The division unit 102 divides the acoustic signal into signals in three frequency bands. The three frequency bands includes: a voice band which is a frequency band mainly including speech components; and two non-voice bands which are other than the voice band. One of the two non-voice bands is a low non-voice band lower than the voice band, and the other one is a high non-voice band higher than the voice band. More specifically, the division unit 102 divides the acoustic signal to extract the signal in the voice band from the acoustic signal. Then, the division unit 102 outputs the signal in the voice band to the suppression unit 103 and also outputs the signals in the low non-voice band and the high non-voice band to the mixing unit 104.

The suppression unit 103 obtains a mode switching signal from the suppression control unit 108. When the mode switching signal indicates switching to the dichotic-listening binaural hearing aid mode, the suppression unit 103 suppresses only a signal in a certain band (i.e., the first suppression-target band) out of the signal in the voice band, and then outputs the suppressed signal in the voice band to the mixing unit 104. On the other hand, when the mode switching signal indicates switching to the normal hearing aid mode, the suppression unit 103 outputs the signal in the voice band to the mixing unit 104 without suppressing this signal.

The mixing unit 104 obtains the signals in the two non-voice bands from the division unit 102 and the signal in the voice band from the suppression unit 103. Then, the mixing unit 104 mixes these three signals. When the signal in the voice band has been suppressed by the suppression unit 103, the mixing unit 104 generates a suppressed acoustic signal by mixing these signals and then outputs the generated signal. When the signal in the voice band has not been suppressed by the suppression unit 103, the mixing unit 104 performs mixing processing to convert the signals obtained as a result of the division by the division unit 102 back into the acoustic signal and then outputs the acoustic signal.

In response to a command from the command sending-receiving unit 107, the hearing compensation unit 105 performs hearing compensation on the acoustic signal or suppressed acoustic signal outputted from the mixing unit 104. For example, as the hearing compensation, the hearing compensation unit 105 adjusts an amplification factor of the acoustic signal or suppressed acoustic signal (i.e., nonlinear amplification processing).

The output unit 106 outputs the acoustic signal or suppressed acoustic signal on which the hearing compensation has been performed by the hearing compensation unit 105.

The command sending-receiving unit 107 receives a command from the remote control 120 via bidirectional communication with the remote control 120, and then sends the command to the suppression control unit 108 or the hearing compensation unit 105. For example, when the received command indicates switching of the hearing aid mode, the command sending-receiving unit 107 sends this command to the suppression control unit 108. When the received command indicates hearing compensation, the command sending-receiving unit 107 sends this command to the hearing compensation unit 105.

The suppression control unit 108 receives the command indicating switching of the hearing aid mode from the command sending-receiving unit 107, and outputs a mode switching signal corresponding to the received command.

The second hearing aid device 110 has the same configuration as the first hearing aid device 100, and thus includes the sound pickup unit 111, a division unit 112, a suppression unit 113, a mixing unit 114, a hearing compensation unit 115, the output unit 116, a command sending-receiving unit 117, and a suppression control unit 118. More specifically, these components are similar in construction to the sound pickup unit 101, the division unit 102, the suppression unit 103, the mixing unit 104, the hearing compensation unit 105, the output unit 106, the command sending-receiving unit 107, and the suppression control unit 108, respectively, which are included in the first hearing aid device 100.

Note, however, that when a signal in a certain band is suppressed out of the signal in the voice band, the suppression units 103 and 111 of the first and second hearing aid devices 100 and 110 suppress signals in different bands. To be more specific, when the mode switching signal indicates the dichotic-listening binaural hearing aid mode, the suppression units 103 and 113 perform the dichotic-listening binaural hearing aid processing. For example, the suppression unit 103 suppresses the signal in the frequency band lower than a frequency fD in the voice band (i.e., the signal in the first suppression-target band), and the suppression unit 113 suppresses the signal in the frequency band higher than the frequency fD in the voice band (i.e., the signal in the second suppression-target band).

Here, the dichotic-listening binaural hearing aid processing in the present embodiment is described as a method of dividing the signal in the voice band, out of the acoustic signal, into signals in two frequency bands and presenting these two signals to the left and right ears, respectively. For example, by the dichotic-listening binaural hearing aid processing in the present embodiment, the signal in the high frequency band (i.e., the second suppression-target band) which is hard to hear, out of the signal in the voice band, because of the frequency masking by the first formant or the temporal masking is outputted from the first hearing aid device 100 fitted on the left ear. Also, the signal in the low frequency band (i.e., the first suppression-target band) including the first formant frequency is outputted from the second hearing aid device 110 fitted on the right as ear. Although the signal in the high frequency band is presented to the left ear and the signal in the low frequency band is presented to the right ear, it should be obvious that the present invention is not limited to this. The signal in the high frequency band may be presented to the right ear and the signal in the low frequency band may be presented to the left ear.

In the present embodiment, a component group including the division unit 102, the suppression unit 103, and the mixing unit 104 of the first hearing aid device 100 corresponds to the first band suppression unit 1300 shown in FIG. 7. Similarly, a component group including the division unit 112, the suppression unit 113, and the mixing unit 114 of the second hearing aid device 110 corresponds to the second band suppression unit 1400 shown in FIG. 7.

Next, the processes performed by the components included in the hearing aid system 1000*a* are described in detail. Firstly, a detailed configuration of the division unit 102 and a connection relation among the division unit 102, the suppression unit 103, and the mixing unit 104 are described.

Figure 10:
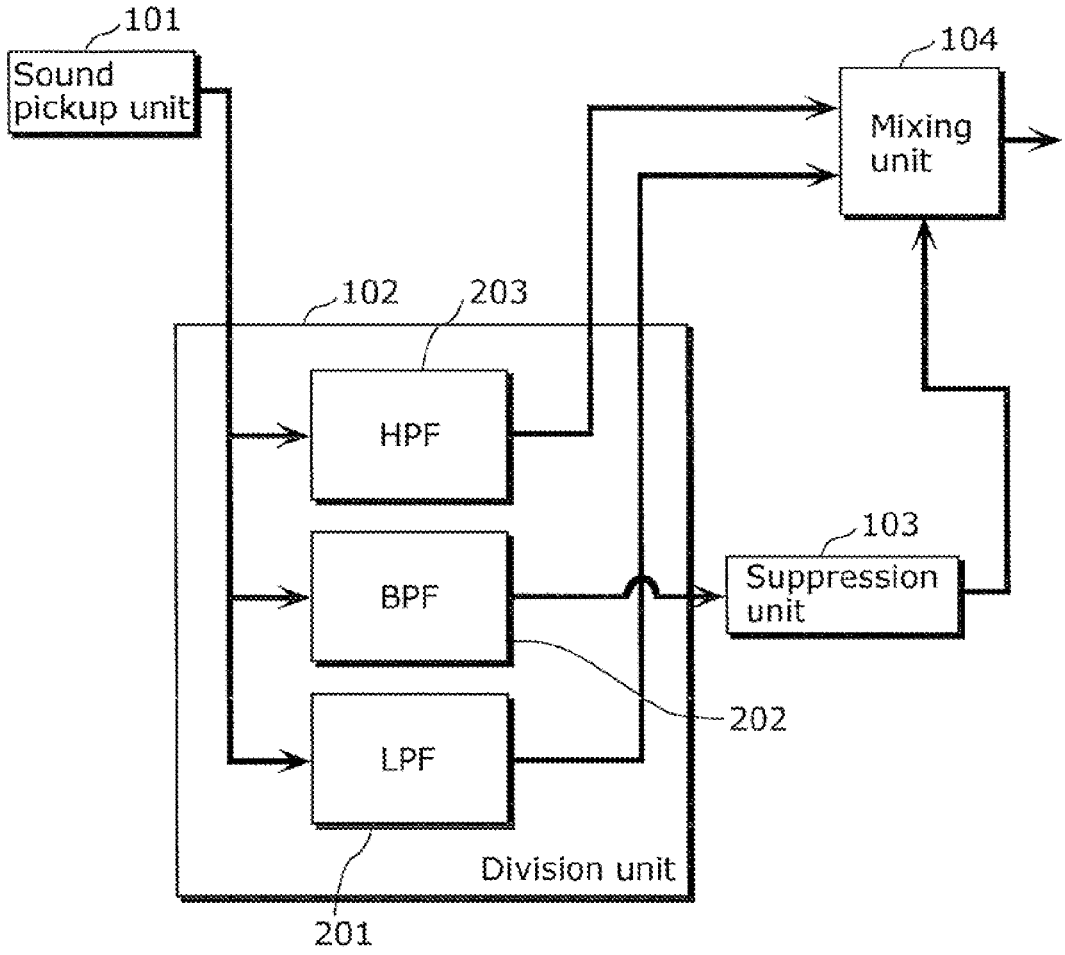
FIG. 10 is a diagram showing a configuration and connection relation of a division unit in the first embodiment according to the present invention.

FIG. 10 is a diagram showing a configuration and connection relation of the division unit 102.

In the present embodiment, the division unit 102 includes a low-pass filter (LPF) 201, a band-pass filter (BPF) 202, and a high-pass filter (HPF) 203. The acoustic signal outputted from the sound pickup unit 101 is entered into the low-pass filter (LPF) 201, the band-pass filter (BPF) 202, and the high-pass filter (HPF) 203 to be filtered. A signal outputted from the BPF 202 is sent, as the signal in the voice band, to the suppression unit 103. Signals outputted from the LPF 201 and the HPF 203 are sent, as the signals in the non-voice band, to the mixing unit 104. The mixing unit 104 mixes these signals with the signal sent from the suppression unit 103, and then sends the mixed signal to the hearing compensation unit 105. It should be noted that the division unit 112 has the same configuration as the division unit 102 shown in FIG. 10 and that a connection relation among the division unit 112, the suppression unit 113, and the mixing unit 114 is the same as shown in FIG. 10.

In this way, each of the division units 102 and 112 divides the acoustic signal into the signals in the three frequency bands, using the LPF 201, the BPF 202, and the HPF 203.

Figure 11:
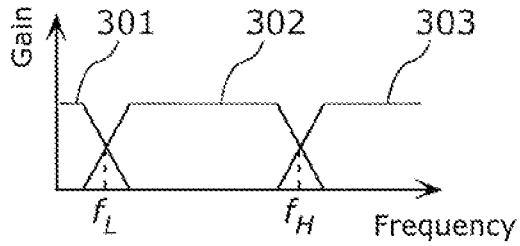
FIG. 11 is a diagram showing gain-frequency characteristics for each of filters included in the division unit in the first embodiment according to the present invention.

Next, the division of the acoustic signal by the division unit 102 is explained in detail, with reference to FIG. 11. Note that the same explanation can be applied to the division unit 112.

FIG. 11 is a diagram showing gain-frequency characteristics for each of the filters included in the division unit 102. In FIG. 11, a solid line 301 indicates an example of the gain of the LPF 201, a solid line 302 indicates an example of the gain of the BPF 202, and a solid line 303 indicates an example of the gain of the HPF 203. The gains of these filters are set according to a control signal from the suppression control unit 108 so that the acoustic signal is adequately divided. The following explains a case, as an example, where the dichotic-listening binaural hearing aid processing is performed to improve the clarity of speech in an environment having sounds in a mix of human speech, a noise in a low frequency band emitted from a vehicle or the like, and a sound in a high frequency band such as a bell sound.

The suppression control unit 108 firstly sets a crossover frequency fL of the LPF 201 and the BPF 202 at a frequency lower than a first formant frequency f1 of speech. In general, the first formant frequency f1 is in a range from 200 Hz to 1200 Hz. On this account, the suppression control unit 108 sends a control signal to the division unit 102 to set the crossover frequency fL at, for example, 200 Hz. Similarly, a crossover frequency fH of the BPF 202 and the HPF 203 is set at a frequency, higher than a second formant frequency f2 of speech. In general, the second formant frequency f2 is in a range from 800 Hz to 3000 Hz, and there are consonants identified by spectral shapes in a frequency band higher than the second formant frequency f2. Thus, the suppression control unit 108 sends a control signal to the division unit 102 to set the crossover frequency fH at, for example, 4 kHz which is away from the upper limit of the second formant frequency. After the crossover frequencies fL and fH are set in this way, the signal outputted from the BPF 202 includes the first and second formants necessary to recognize speech. On the other hand, the signal outputted from the LPF 201 mainly includes non-voice components, such as traffic noises, in a low frequency band. The signal outputted from the HPF 203 includes a component of alarm sound, such as a bicycle bell sound, and low frequency components relatively less affected by the masking of the first formant frequency. The division unit 102 sends, to the suppression unit 103, the signal outputted from the BPF 202. Moreover, the division unit 102 sends, to the mixing unit 104, the signals outputted from the LPF 201 and the HPF 203.

The suppression unit 103 is configured with an HPF to allow the first hearing aid device 100 to output the high frequency components of speech which is hard to hear due to the frequency masking and the temporal masking, and thus suppresses the low frequency components of the signal outputted from the BPF 202.

Figure 12A:
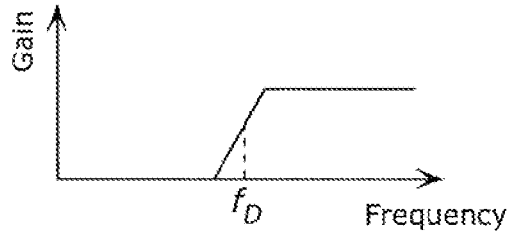
FIG. 12A is a diagram showing gain-frequency characteristics of a suppression unit configured as an HPF in the first embodiment according to the present invention.

FIG. 12A is a diagram showing gain-frequency characteristics of the suppression unit 103 configured as the HPF. A cutoff frequency fD of the suppression unit 103 is set at, for example, 1250 Hz which is higher than the first formant frequency f1 and lower than the second formant frequency f2 so as not to be affected by the frequency masking or the temporal masking.

The cutoff frequency fD may be set in advance according to auditory characteristics of the user of the hearing aid system 1000*a*, or may be set according to a control signal from the suppression control unit 108.

The description thus far can be summarized by Equation 1 as follows which shows a relationship among the speech formant frequencies f1 and f2 of the first hearing aid device 100, the crossover frequencies fL and fH of the division unit 102, and the cutoff frequency fD of the suppression unit 103.

$$fL<f1<fD<f2<fH \qquad \text{Equation 1}$$

The suppression unit 113 of the second hearing aid device 110 is configured with an LPF to suppress the high frequency components of the signal outputted from a band-pass filter (BPF) of the division unit 112.

Figure 12B:
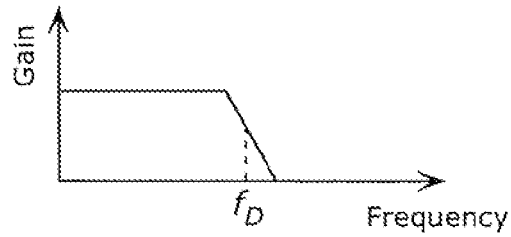
FIG. 12B is a diagram showing gain-frequency characteristics of a suppression unit configured as an LRF in the first embodiment according to the present invention.

FIG. 12B is a diagram showing gain-frequency characteristics of the suppression unit 113 configured as the LPF. A cutoff frequency fD of the suppression unit 113 is set to satisfy Equation 2 as follows, as is the case with the cutoff frequency fD of the suppression unit 103 of the first hearing aid device 100.

$$fL<f1<fD<f2<fH \qquad \text{Equation 2}$$

It should be obvious that the present invention is not limited to the case where the high frequency sound is presented from the left side (i.e., from the first hearing aid device 100) and the low frequency sound is presented from the right side (i.e., from the second hearing aid device 110). The present invention includes a case where right and left are reversed. Also, the cutoff frequencies fD of the suppression units 103 and 113 may be different from each other.

The signal processed by the suppression unit 103 or 113 and the signal outputted from the division unit 102 or 112 are sent to the corresponding mixing unit 104 or 114. Each of the mixing units 104 and 114 adds up the received signals. The signals generated as a result of the additions performed by the mixing units 104 and 114 are sent to the hearing compensation units 105 and 115, respectively, each of which performs hearing compensation by level correction for each frequency band. The signals generated as a result of the hearing compensations performed by the hearing compensation units 105 and 115 are sent, as sound waves, to the left and right ears of the user, respectively, via the output units 106 and 116 which are the receivers or the like.

Figure 13:
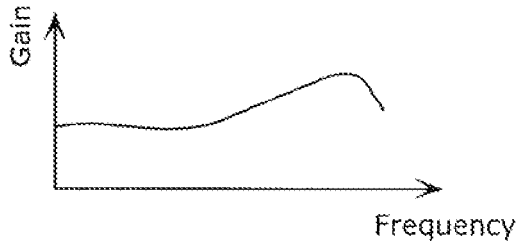
FIG. 13 is a diagram showing gain-frequency characteristics of a hearing compensation unit in the first embodiment according to the present invention.

FIG. 13 is a diagram showing gain-frequency characteristics of the hearing compensation units 105 and 115.

As shown in FIG. 13, each of the hearing compensation units 105 and 115 performs the stated hearing compensation by amplifying the signal (the acoustic signal or the suppressed acoustic signal) outputted from the corresponding mixing unit 104 or 114 so that the gain is larger when the frequency is higher.

Figure 14:
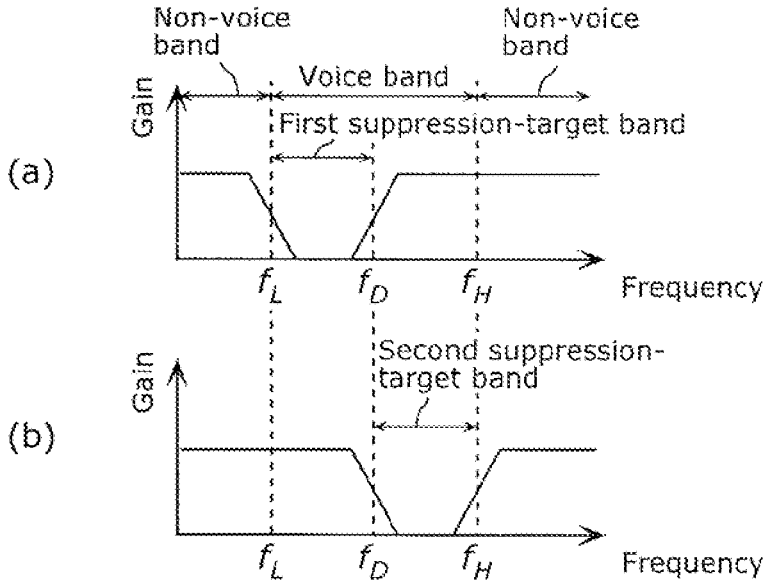
FIG. 14 is a conceptual diagram showing gain-frequency characteristics of first and second band suppression units included in the hearing aid system in the first embodiment according to the present invention.

FIG. 14 is a conceptual diagram showing gain-frequency characteristics of the first and second band suppression units included in the hearing aid system 1000*a*.

As shown in (a) of FIG. 14, the gain of the first band suppression unit is set to be lower in a frequency band from the crossover frequency fL to the cutoff frequency fD (i.e., the first suppression-target band), according to the gain control of the division unit 102, the suppression unit 103, and the mixing unit 104 stated above. Also, as shown in (b) of FIG. 14, the gain of the second band suppression unit is set to be lower in a frequency band from the cutoff frequency fD to the cross-over frequency fH (i.e., the second suppression-target band), according to the gain control of the division unit 112, the suppression unit 113, and the mixing unit 114 stated above.

Next, a series of operations performed by the hearing aid system 1000*a* of the present embodiment in the dichotic-listening binaural hearing aid processing (i.e., the dichotic-listening binaural hearing aid mode) is described.

Figure 15:
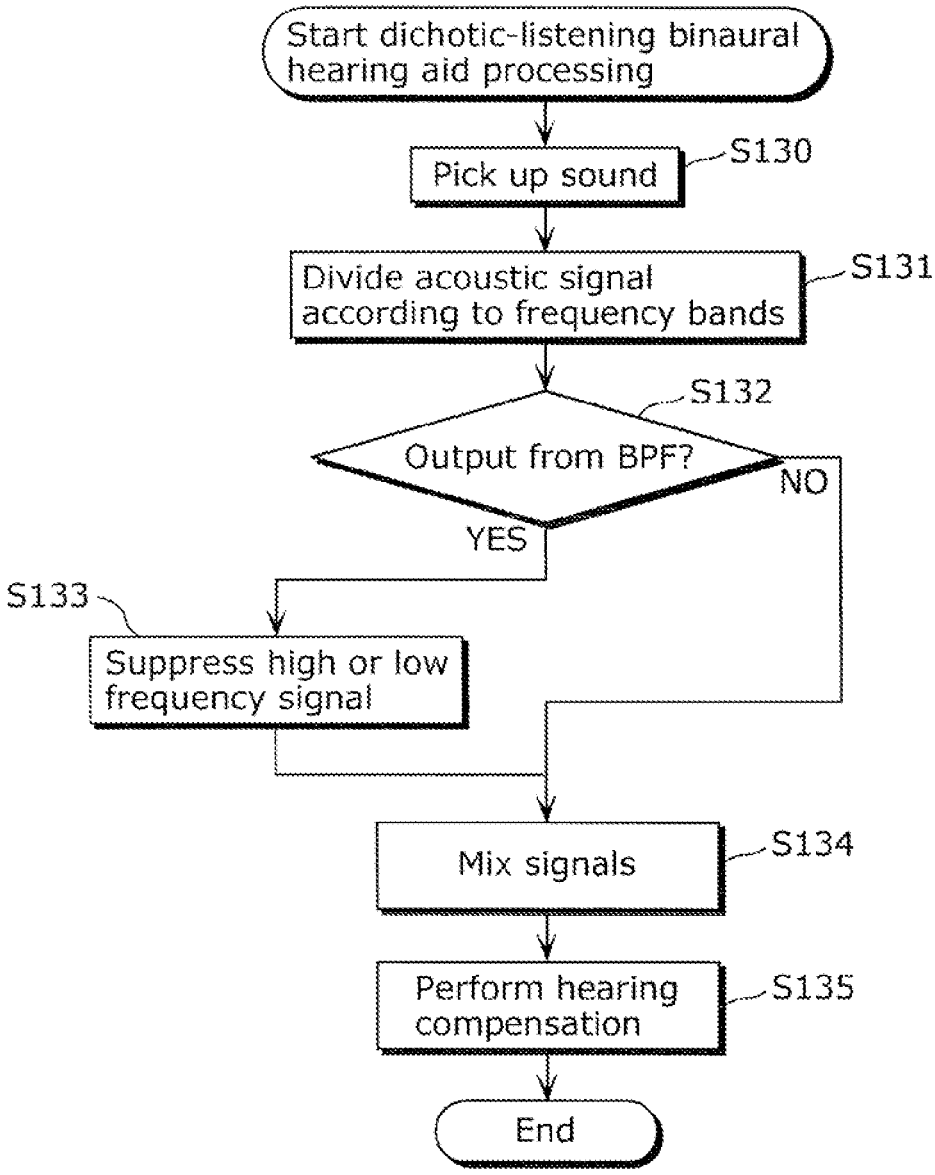
FIG. 15 is a flowchart showing dichotic-listening binaural hearing aid processing performed by a first hearing aid device included in the hearing aid system in the first embodiment according to the present invention.

FIG. 15 is a flowchart showing the dichotic-listening binaural hearing aid processing performed by the first hearing aid device 100 included in the hearing aid system 1000*a*. It should be noted that the second hearing aid device 110 performs the same dichotic-listening binaural hearing aid processing as shown in FIG. 15.

Firstly, the sound pickup unit 101 of the first hearing aid device 100 picks up an ambient sound, and sends an acoustic signal generated from the picked-up sound to the division unit 102 (step S130). The division unit 102 divides the acoustic signal received from the sound pickup unit 101 according to frequency bands (step S131). Here, the division unit 102 may perform filter processing for each sample of the acoustic signal, or may perform the Fourier transform for each set of samples (128 samples, for example) to divide the acoustic signal in the frequency domain. As a result of the division performed in step S131, the acoustic signal is divided into a signal outputted from the LPF 201 (i.e., the signal in the low non-voice band), a signal outputted from the BPF 202 (i.e., the signal in the voice band), and the signal outputted from the HPF 230 i.e., the signal in the high non-voice band). Accordingly, three signals are generated.

Next, the division unit 102 determines, for each of the signals generated as the result of the division, whether or not the signal is outputted from the BPF 202 (i.e., the signal in the voice band) (step S132). When determining that the signal is outputted from the BPF 202 (YES in step S132), the division unit 102 sends the present signal to the suppression unit 103.

When receiving, from the suppression control unit 108, the mode switching signal indicating switching to the dichotic-listening binaural hearing aid mode, the suppression unit 103 suppresses a high or low frequency signal out of the signal (i.e., the signal in the voice band) according to the presetting (step S133). Here, as in the case of the process performed in step S131, the suppression unit 103 may perform the filter processing for each sample of the signal in the voice band, or may perform the suppression for each set of samples in the frequency domain. The mixing unit 104 mixes this suppressed signal and the two signals outputted from the filters other than the BPF 202 (step S134). The mixed signal is sent, as the suppressed acoustic signal, to the hearing compensation unit 105. The hearing compensation unit 105 performs hearing compensation on the suppressed acoustic signal and causes the output unit 106 to output a sound indicated by the suppressed acoustic signal on which the hearing compensation has been performed (step S135).

In the case where the hearing aid system 1000*a* in the present embodiment performs the normal hearing aid processing (i.e., the normal hearing aid mode), the suppression unit 103 of the first hearing aid device 100 sends, to the mixing unit 104, the signal in the voice band outputted from the division unit 102 without performing the suppression. As in the case of the first hearing aid device 100, the suppression unit 113 of the second hearing aid device 110 sends, to the mixing unit 114, signal in the voice band outputted from the division unit 112 without performing the suppression.

Next, control to switch between the hearing aid modes is explained. When wishing to more clearly hear the voice of a person with whom the user is having a conversation for example, the user operates the remote control 120 to enable the hearing aid system 1000*a* to perform the dichotic-listening binaural hearing aid processing. The remote control 120 sends a signal corresponding to the operation, as a command (i.e., the mode switching command), to the first and second hearing aid devices 100 and 110. Each of the command sending-receiving units 107 and 117 of the first and second hearing aid devices 100 and 110 receives this command. Each of the command sending-receiving units 107 and 117 sends the command to the corresponding suppression control unit 108 or 118. Receiving the command, each of the suppression control units 108 and 118 sends, to the corresponding suppression unit 103 or 113, the mode switching signal indicating switching to the dichotic-listening binaural hearing aid mode to control the operation performed by the suppression unit 103 or 113. By these operations thus far, the hearing aid mode is switched from the normal hearing aid mode to the dichotic-listening binaural hearing aid mode.

Here, when the hearing aid mode is switched from the normal hearing aid mode to the dichotic-listening binaural hearing aid mode, it is preferable that the first hearing aid device 100 and the second hearing aid device 110 for both ears be switched to the dichotic-listening binaural hearing aid mode. For example, when only one of the first and second hearing aid devices 100 and 110 can receive the command from the remote control 120 via the wireless communication, the hearing aid mode may be different between the first and second hearing aid devices 100 and 110.

In order to avoid the case where the first and second hearing aid devices 100 and 110 operate in the different modes, the remote control unit 120 may determine, before sending the command to switch the hearing aid mode (i.e., the mode switching command), whether or not the hearing aid mode switching can be performed by the first and second hearing aid devices 100 and 110. This determination can be made by sending, from the remote control 120, a mode-switching verification command for determining whether the hearing aid mode can be switched and by receiving, from each of the first and second hearing aid devices 100 and 110, an acknowledgment signal indicating that the mode-switching verification command has been received.

Figure 16:
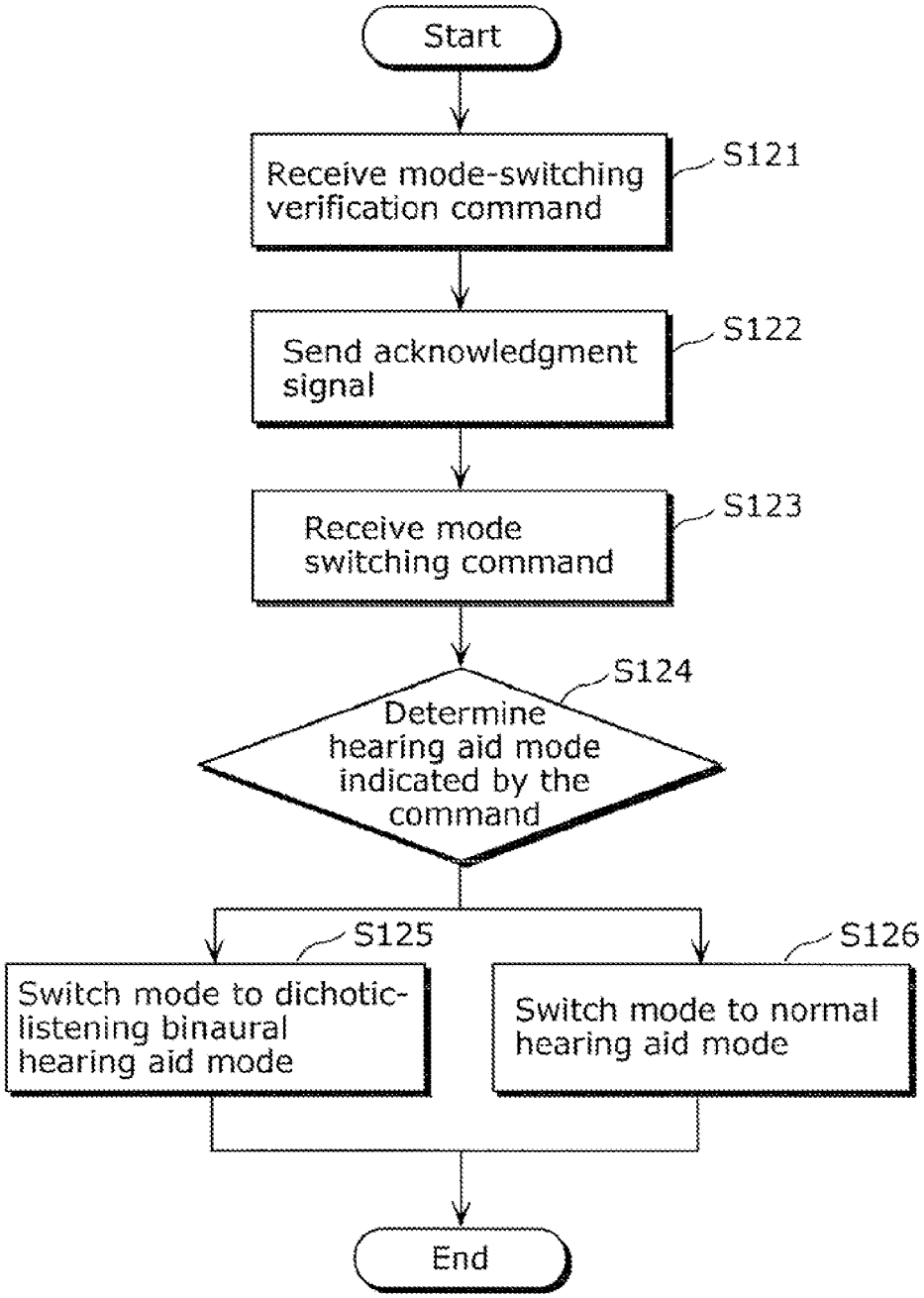
FIG. 16 is a flowchart showing an operation performed by each of the first and second hearing aid devices to switch a hearing aid mode in response to a mode-switching verification command received from a remote control, in the first embodiment according to the present invention.

FIG. 16 is a flowchart showing an operation performed by each of the first and second hearing aid devices 100 and 110 to switch the hearing aid mode in response to the mode-switching verification command received from the remote control 120.

Firstly, each of the command sending-receiving units 107 and 117 of the first and second hearing aid devices 100 and 110 receives the mode-switching verification command sent from the remote control 120 according to the operation performed by the user (step S121). When the command is received normally in step S121, each of the command sending-receiving units 107 and 117 of the first and second hearing aid devices 100 and 110 sends the acknowledgment signal to the remote control 120 (step S122). Upon receiving the acknowledgment signals from both the first and second hearing aid devices 100 and 110 for the left and right ears, the remote control 120 sends the mode switching command to each of the command sending-receiving units 107 and 117 of the first and second hearing aid devices 100 and 110. Each of the command sending-receiving units 107 and 117 receives the mode switching command (step S123). Then, each of the suppression control units 108 and 118 determines the hearing aid mode indicated by the present mode switching command (that is, the dichotic-listening binaural hearing aid mode or the normal hearing aid mode) (step S124). Here, when the mode switching command indicates the dichotic-listening binaural hearing aid mode, each of the first and second hearing aid devices 100 and 110 switches the mode to the dichotic-listening binaural hearing aid mode and thus performs the dichotic-listening binaural hearing aid processing (step S125). On the other hand, when the mode switching command indicates the normal hearing aid mode, each of the first and second hearing aid devices 100 and 110 switches the mode to the normal hearing aid mode and thus performs the normal hearing aid processing (step S126).

Instead of operating the remote control 120, the user may operate the switches 109 and 119 included in the main units of the first and second hearing aid devices 100 and 110, respectively. In this case, when wishing to hear more clearly the voice of the person the user is talking to, the user operates the switches 109 and 119 to enable the hearing aid system 1000*a* to perform the dichotic-listening binaural hearing aid processing. Then, each of the command sending-receiving units 107 and 117 receives a signal corresponding to this operation. Accordingly, the same processing as performed by the remote control 120 for switching the hearing aid mode is performed.

In this case, the modes of the hearing aid devices 100 and 110 for both ears may be switched to the same hearing aid mode by operating only the switch 109 or 119 of the corresponding hearing aid device 100 or 110 for one of the ears. For example, the first and second hearing aid devices 100 and 110 are connected via a wireless communication medium. Then, when the hearing aid mode is switched using the switch included in one of the hearing aid devices, the corresponding one of the command sending-receiving units 107 or 117 of the hearing aid device sends a control signal indicating switching of the hearing aid mode to the other one of the command sending-receiving unit 117 or 107.

In the case of switching the hearing aid mode by operating only one of the switches 109 or 119, it is also preferable that the hearing aid modes of the first and second hearing aid devices 100 and 110 be switched to the same hearing aid mode as in the above case of switching the hearing aid mode using the remote control 120. The following describes an example where the hearing aid modes of the first and second hearing aid devices 100 and 110 are switched by operating the switch 109 of the first hearing aid device 100. It should be noted that when the switching is performed by operating the switch 119 of the second hearing aid device 110, the same processing as in the case of operating the switch 109 is performed.

Firstly, when the switch 109 of the first hearing aid device 100 is operated, the command sending-receiving unit 107 of the first hearing aid device 100 sends the mode-switching verification command corresponding to the operation. When this mode-switching verification command is normally received, the command sending-receiving unit 117 of the second hearing aid device 110 sends the acknowledgment signal to the first hearing aid device 100. The command sending-receiving unit 107 of the first hearing aid device 100 receives the acknowledgment signal from the second hearing aid device 110, and sends the mode switching command to the command sending-receiving unit 117 of the second hearing aid device 110. After receiving the mode switching command, the second hearing aid device 110 switches the current hearing aid mode to the mode indicated by the mode switching command. Also, after sending the mode switching command, the first hearing aid device 100 switches the current hearing aid mode to the mode indicated by the mode switching command. Moreover, in consideration of a length of time required to send and receive the commands and signals between the hearing aid devices, the first hearing aid device 100 may switch the hearing aid mode at the conclusion of a set elapsed time (for example, 1 msec) after the operation is performed on the switch 109.

Although the sounds outputted from the output units 106 and 116 change after the hearing aid mode is switched, it may be hard for the user to notice the switching. On account of this, it is recommendable to notify the user that the hearing aid mode has been switched.

To be more specific, when the hearing aid mode is switched, the remote control 120 in the present embodiment notifies the user about the switching of the hearing aid mode or the currently-set hearing aid mode, by displaying a symbol, a pictorial figure, or a word indicating the switching. Also, the notification may be made by a light emission or a flashing light using an LED or the like. Moreover, in the case where the remote control 120 includes a speaker, a sound notifying the switching of the hearing aid mode may come out of the speaker. Furthermore, in the case where the remote control 120 includes a vibrator, the switching of the hearing aid mode may be notified by vibration. Also, in the case where the remote control 120 includes a means of communication, the remote control 120 may send a signal indicating that the hearing aid mode has been switched to the other devices so as to allow the other devices receiving the signal to display the same indication as described above.

Moreover, in place of the remote control 120, the first and second hearing aid devices 100 and 110 may notify the switching of the hearing aid mode. In this case, when the notification is made by the light or display as in the case of the remote control 120, it is hard for the user to notice this notification. Hence, the notification may be made by a sound. However, in the case of making the notification by a sound, a creative method is required such that the user can distinguish between the ambient sound and the sound notifying that the hearing aid mode has been switched. Also, it is preferable to notify the user which ear will hear a larger sound in a low or high frequency band. For example, the notification may be made by presenting two signals sequentially from the first and second hearing aid devices 100 and 110. In the case of the dichotic-listening binaural hearing aid processing of dividing the frequency band into low and high frequency bands and presenting the different frequency characteristics to the ears, respectively, the hearing aid system 1000*a* first presents, to the ear for hearing the low frequency components, a brief notification sound perceivable by the user. Here, this brief notification sound includes a component of a frequency perceivable by the user (for example, 500 Hz) and lower than the cutoff frequency fD. Next, the hearing aid system 1000*a* presents, to the ear for hearing the high frequency components, a brief notification sound perceivable by the user. Here, this brief notification sound includes a component of a frequency perceivable by the user (for example, 1.5 kHz) and higher than the cutoff frequency fD. During, before, or after the notification sound output, the hearing aid system 1000*a* may perform processing of turning down the volume of the external sound or may mask the external sound. Moreover, it is preferable to generate each of the notification sounds mainly as a sine wave signal so that the sound is hard to be spatially localized. With this, the user can notice the start of the dichotic-listening binaural hearing aid mode in an environment having ambient sounds, and can also know which ear will hear a sound with low frequency emphasis. By the present method, the notification sounds are made at different timings for the left and right ears. However, within a time range in which these notification sounds do not completely coincide with each other, there may be a moment when both of the notification sounds are being outputted at the same time. In this case, it is preferable to set a length of time in which the notification sounds are being outputted at the same time is equal to or lower than 50% of the entire length of each notification sound. This is because, when the length of time in which the notification sounds are being outputted at the same time is longer, it is difficult for the user to know which ear will hear a sound with low or high frequency emphasis.

Also, not only when the hearing aid mode is switched from the normal hearing aid mode to the dichotic-listening binaural hearing aid mode, but also when the hearing aid mode is switched from the dichotic-listening binaural hearing aid mode to the normal hearing aid mode, the hearing aid system 1000*a* in the present embodiment performs the same control and makes the same notification about switching of the hearing aid mode as described above. When the hearing aid mode is switched to the normal hearing aid mode, the notification sounds may be presented sequentially in reverse order of the case of switching to the dichotic-listening binaural hearing aid mode. However, in this case, it is unnecessary to notify the user which ear will hear a low or high frequency sound. On this account, any kind of sound may be used as long as the user can notice the switching.

Note that, in the case where the first and second hearing aid devices 100 and 110 include vibrators, the switching of the hearing aid mode may be notified by vibration, for example.

In the present embodiment as described thus far, out of the signal including the main speech components (i.e., the signal in the voice band), one ear is presented with the low frequency components including the first formant while the other ear is presented with: the second formant frequency components which are hard to hear because of the influence of the frequency masking by the first formant or the temporal masking; and the high frequency components including consonant components. With this, a decrease in the clarity of speech due to the frequency masking or temporal masking occurring in the signal including the speech components can be reduced by the dichotic-listening binaural hearing aid processing.

Moreover, in the present embodiment, the division unit 102 outputs, to the mixing unit 104 by bypassing the suppression unit 103, the signals extracted by the HPF 203 and LPF 201. Then, these signals are mixed, as stereo signals, with the signal in the voice band. As with the division unit 102, the division unit 112 also outputs, to the mixing unit 114 by bypassing the suppression unit 113, the signals extracted by the HPF 203 and LPF 201. Then, these signals are mixed, as stereo signals, with the signal in the voice band. As a result, the user can hear the ambient sounds, other than the main speech components, in stereo.

Figure 5A:
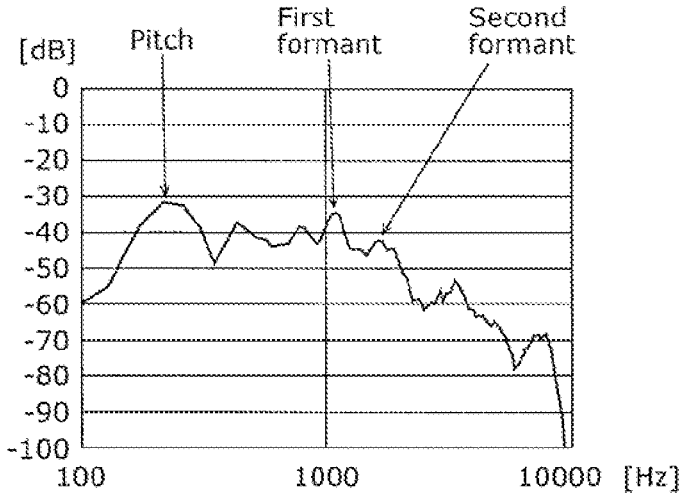
FIG. 5A is a diagram showing a frequency spectrum of speech.
Figure 5B:
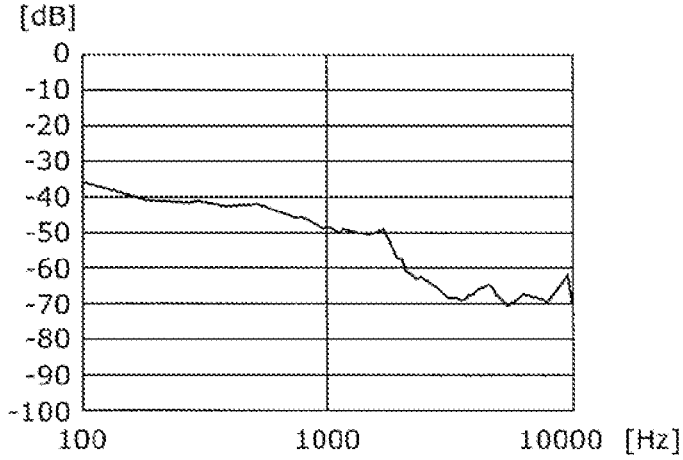
FIG. 5B is a diagram showing a frequency spectrum of ambient noises L and R.
Figure 5C:
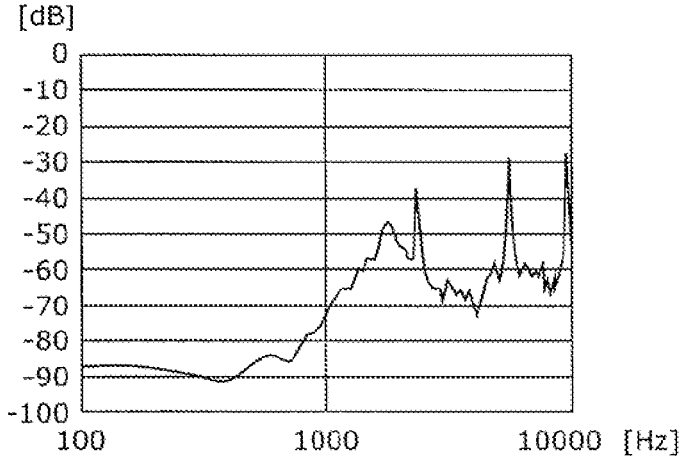
FIG. 5C is a diagram showing a frequency spectrum of an alarm sound.
Figure 6:
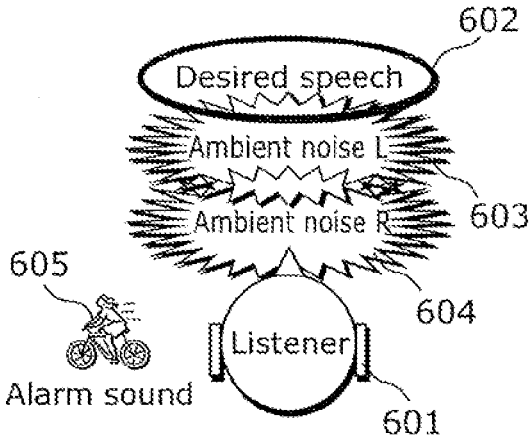
FIG. 6 is a diagram explaining a problem caused by conventional dichotic-listening binaural hearing aid processing.

In this way, in the present embodiment, the dichotic-listening binaural hearing aid processing is performed while the sounds in the non-voice bands can be heard in stereo. This can solve the problem that the ambient noises L and R and alarm sound from the sound sources 603 to 605 are perceived as if these sounds were all from the same direction as the desired speech of the source source 602, as shown in FIG. 6. To be more specific, in the present embodiment, the dichotic-listening binaural hearing aid processing is performed on the signal including the main speech components. Thus, the clarity of the desired speech from the sound source 602 can be improved. Also, the components of the ambient noises L and R and alarm sound from the sound sources 603 to 605 are heard in stereo, meaning that the sounds can be heard from the actual directions of the sound sources 603 to 605. Moreover, the alarm sound from the sound source 605 having the frequency characteristics as shown in FIG. 5C is heard in stereo. Thus, this alarm sound is heard from the actual direction, instead of the direction of the ear which is presented with the high frequency sound by the dichotic-listening binaural hearing aid processing. Since the sound is heard from the actual direction, the user can perceive the approach of a warning sound, such as a car horn.

In this way, the present embodiment can improve the clarity of speech and can also separate the ambient sounds spatially. Instead of simply performing the dichotic-listening binaural hearing aid processing only on the frequency band including many speech components, the sound in the band including many non-voice components is presented in stereo. This configuration allows noises in the frequency band including many speech components to be easily separated, thereby increasing the clarity of speech (i.e., noise immunity).

Figure 1A:
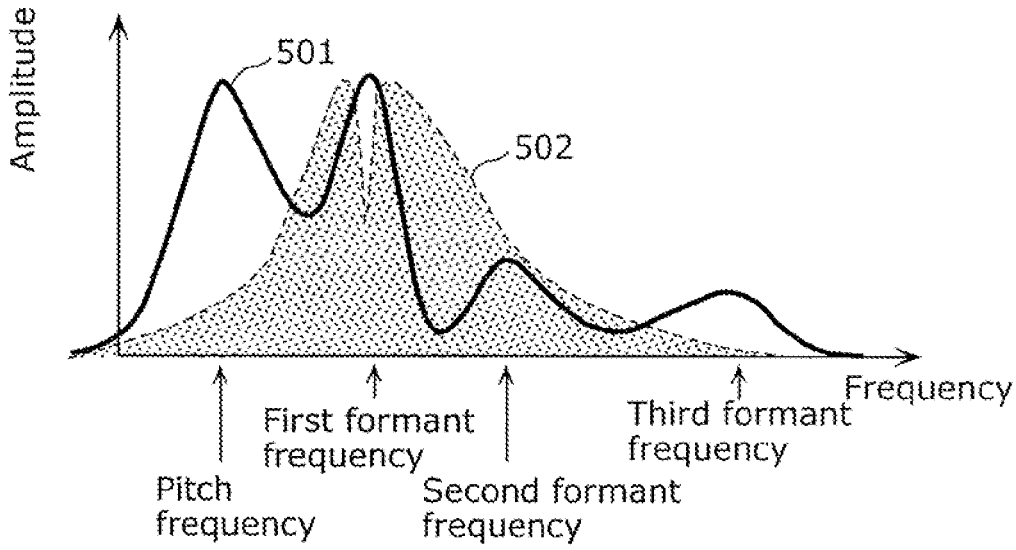
FIG. 1A is a diagram showing a frequency spectrum of speech.
Figure 1B:
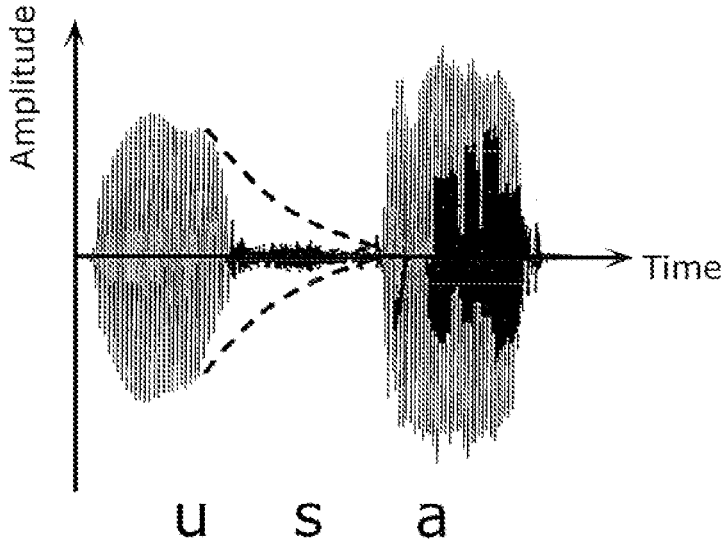
FIG. 1B is a diagram showing a temporal waveform of speech.
Figure 2A:
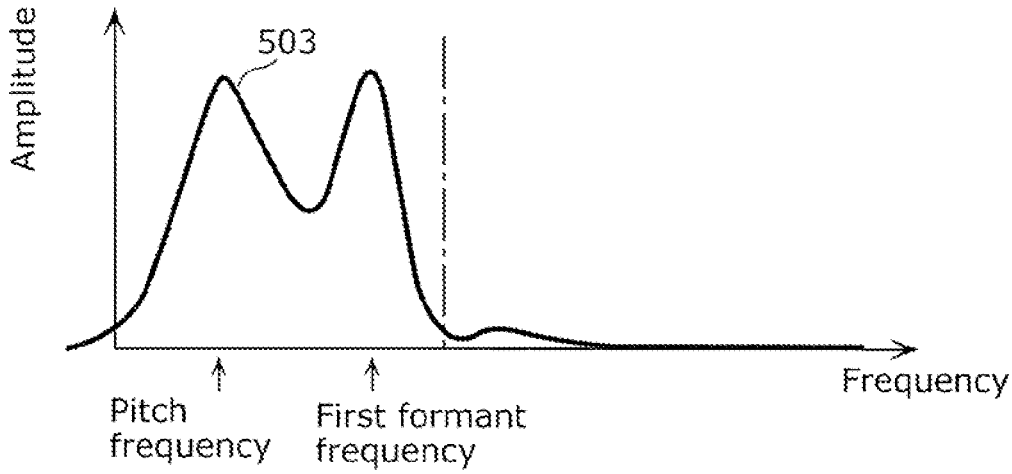
FIG. 2A is a diagram showing one of frequency spectra of speech on which the dichotic-listening binaural hearing aid processing has been performed.
Figure 2B:
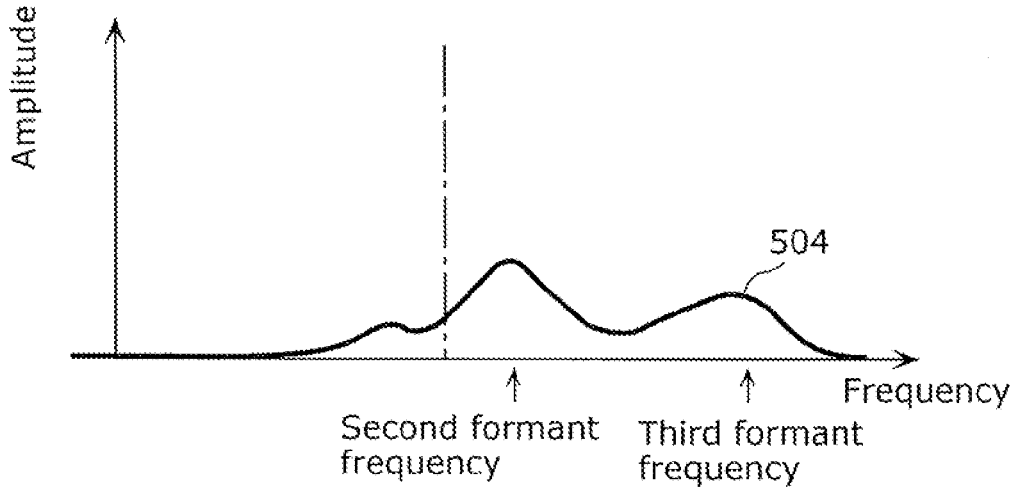
FIG. 2B is a diagram showing the other one of frequency spectra of speech on which the dichotic-listening binaural hearing aid processing has been performed.
Figure 3A:
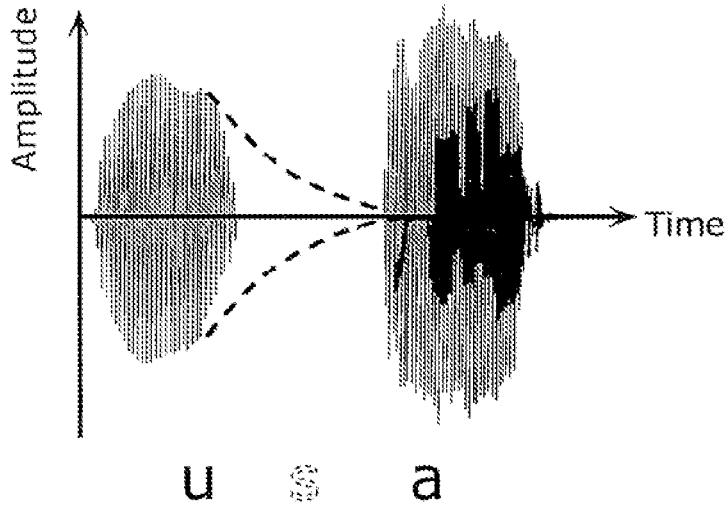
FIG. 3A is a diagram showing one of temporal waveforms of speech on which the dichotic-listening binaural hearing aid processing has been performed.
Figure 3B:
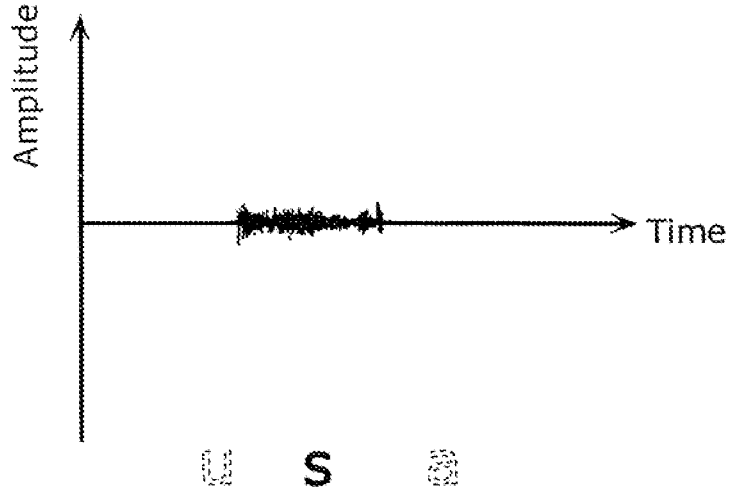
FIG. 3B is a diagram showing the other one of temporal waveforms of speech on which the dichotic-listening binaural hearing aid processing has been performed.
Figure 4:
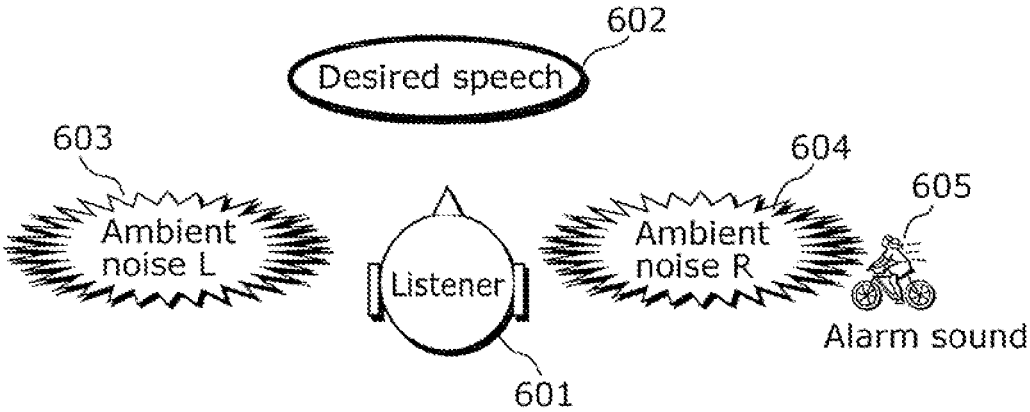
FIG. 4 is a diagram showing an arrangement of sounds with respect to a listener.

In the conventional dichotic-listening binaural hearing aid processing, all the sounds in the low frequencies having large power are presented to only one ear, out of all bands of sounds present in the environment shown in FIG. 4. This may possibly cause a feeling of pressure to a hearing-impaired person. On the other hand, the present embodiment allows the frequency components lower than the main speech components to be heard in natural stereo by both ears, instead of one ear. Therefore, feelings of discomfort and exhaustion of the user can be reduced.

Accordingly, the present embodiment can improve the clarity of speech while maintaining natural spatiality of sounds in an environment.

(First Modification)

Here, the first modification in the present embodiment is described. As compared to the first and second hearing aid devices 100 and 110 of the hearing aid system 1000*a* in the stated embodiment, the arrangement of hearing compensation units is different in first and second hearing aid devices of a hearing aid system in the present modification.

Figure 17:
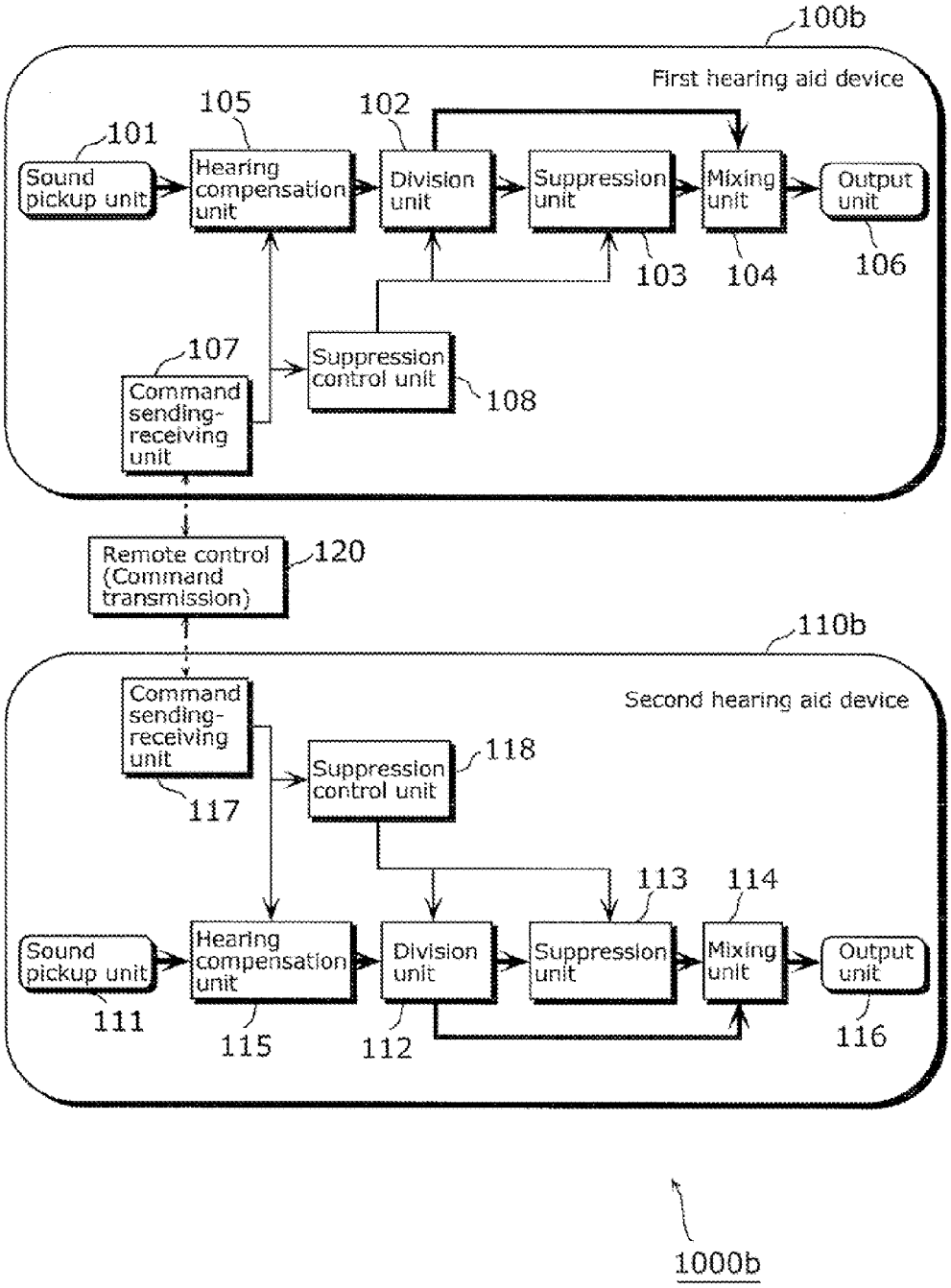
FIG. 17 is a functional block diagram of a hearing aid system in a first modification of the first embodiment according to the present invention.

FIG. 17 is a functional block diagram of the hearing aid system in the present modification.

A hearing aid system 1000*b* in the present modification includes: first and second hearing aid devices 100*a* and 110*b*; and a remote control 120.

The first and second hearing aid devices 100*a* and 110*b* in the present modification include the same components as the first and second hearing aid devices 100 and 110 in the above embodiment, respectively. However, the hearing compensation units 105 and 115 are arranged before the division units 102 and 112, respectively. To be more specific, each of the hearing compensation units 105 and 115 performs hearing compensation on the acoustic signal outputted from the corresponding sound pickup unit 101 or 111. Also, each of the division units 102 and 112 of the first and second hearing aid devices 100*b* and 110*b* in the present modification divides the hearing-compensated signal outputted from the corresponding hearing compensation unit 105 or 115 according to frequency bands.

Accordingly, even in the case of the present modification where the hearing compensation units 105 and 115 are arranged before the division units 102 and 112, respectively, the same advantageous effect as in the above embodiment can be achieved.

(Second Modification)

Here, the second modification in the present embodiment is described. As compared to the hearing aid system 1000*a* in the above embodiment, a division unit has a different configuration in a hearing aid system of the present modification.

Figure 18:
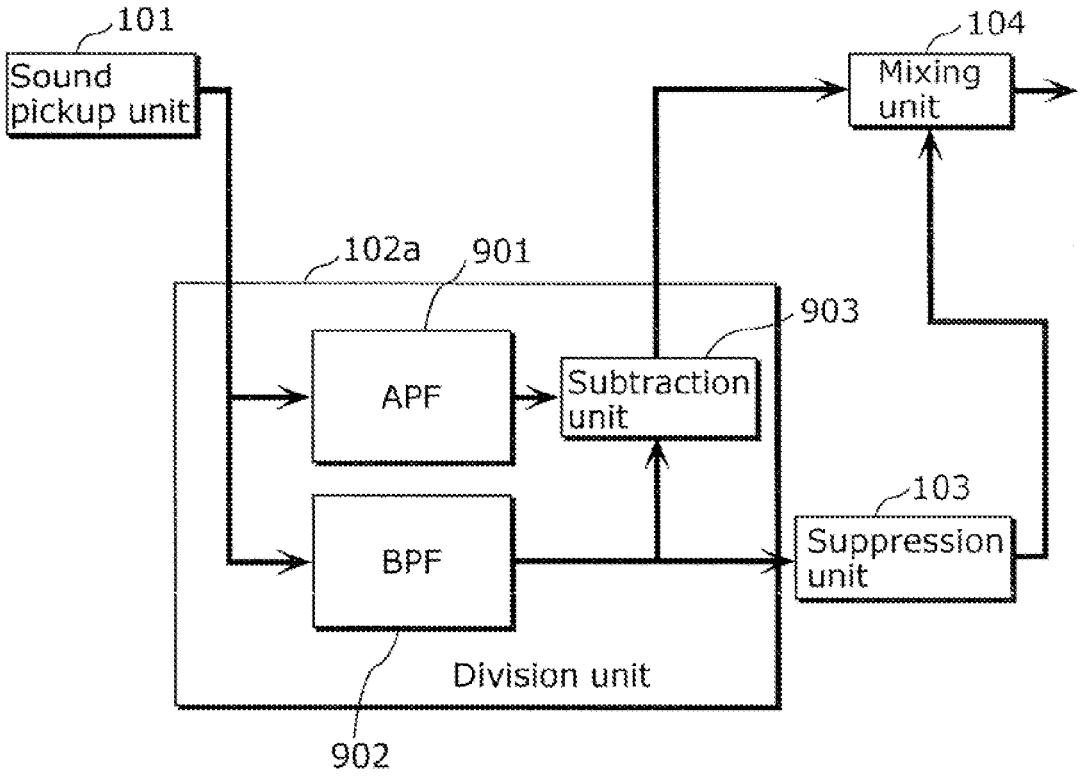
FIG. 18 is a diagram showing a configuration and connection relation of a division unit included in a hearing system in a second modification of the first embodiment according to the present invention.

FIG. 18 is a diagram showing a configuration and connection relation of the division unit included in the hearing system in the present modification.

As shown in FIG. 18, a division unit 102*a* in the present modification includes an all-pass filter (APF) 901, a BPF 902, and a subtraction unit 903. The APF 901 receives an acoustic signal outputted from the sound pickup unit 101, and outputs signals in all frequency bands (i.e., signal in an entire band) included in the acoustic signal. The BPF 902 is a filter for extracting a signal including main speech components (i.e., the signal in the voice band), and has the same characteristics as the BPF 202 shown in FIG. 10 in the stated embodiment. More specifically, the BPF 902 receives the acoustic signal outputted from the sound pickup unit 101, and outputs the signal in the voice band included in the acoustic signal. The subtraction unit 903 generates a signal in the non-voice band by subtracting or eliminating the signal in the voice band from the signal in the entire band outputted from the APF 901.

The suppression unit 103 suppresses a signal in a low or high frequency band out of the signal in the voice band outputted from the BPF 902, and then outputs the suppressed signal in the voice band. The mixing unit 104 mixes the signal in the non-voice band generated by the subtraction unit 903 and the suppressed signal in the voice band outputted from the suppression unit 103. It should be noted that this division unit 102*a* may be included in place of each of the division units 102 and 112 of the first and second hearing aid devices 100 and 110, or may be included in place of either one of the division units 102 and 112.

Accordingly, even in the case of the present modification where the division unit 102*a* has a configuration different from the configurations of the division units 102 and 112, the same advantageous effect as in the above embodiment can be achieved.

(Third Modification)

Here, the third modification in the present embodiment is described. Features of a hearing aid system in the present modification include dynamically changing the crossover frequencies fL and fH and the cutoff frequency fD according to the acoustic signal.

Figure 19:
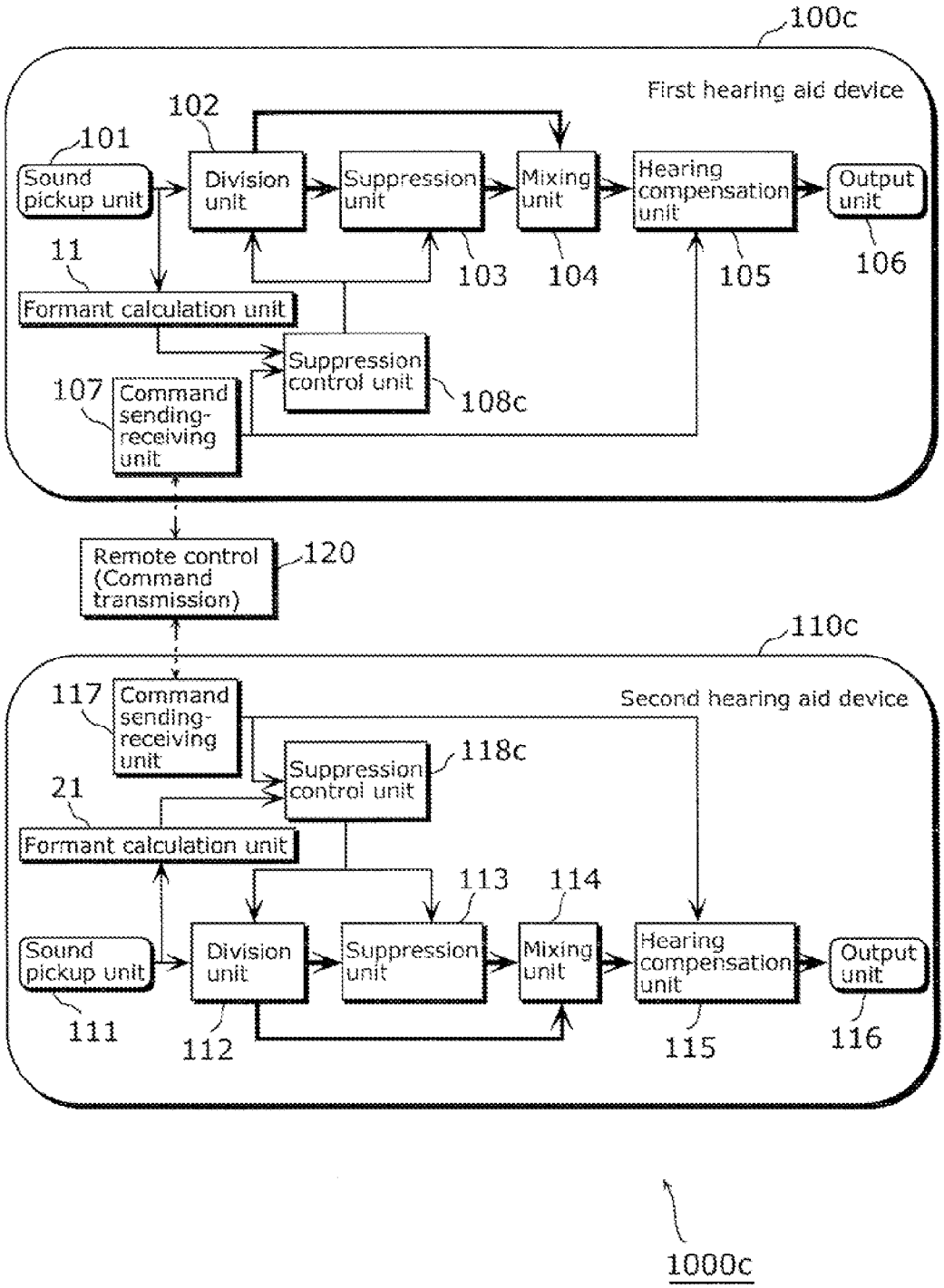
FIG. 19 is a functional block diagram of a hearing aid system in a third modification of the first embodiment according to the present invention.

FIG. 19 is a functional block diagram of the hearing aid system in the present modification.

A hearing aid system 1000*c* in the present modification includes: first and second hearing aid devices 100*c* and 110*c*; and a remote control 120.

As compared to the first hearing aid device 100 in the above embodiment, the first hearing aid device 100*c* in the present modification includes: a formant calculation unit 11 in addition; and a suppression control unit 108*c* in place of the suppression control unit 108. As compared to the second hearing aid 110 in the above embodiment, the second hearing aid device 110*c* in the present modification also includes: a formant calculation unit 21 in addition; and a suppression control unit 118*c* in place of the suppression control unit 118, as with the first hearing aid device 100*c*.

Each of the formant calculation units 11 and 21 calculates the first formant frequency f1 and the second formant frequency f2 on the basis of the acoustic signal outputted from the corresponding sound pickup unit 101 or 111. From the first formant frequency f1 and the second formant frequency f2 calculated by the formant calculation units 11 and 21, the suppression control units 108*c* and 118*c* derive the crossover frequencies fL and fH and the cutoff frequency fD which satisfy Equations 1 and 2 described above. Then, the suppression control units 108*c* and 118*c* control the division units 102 and 112, respectively, so that the frequency band is divided according to the derived crossover frequencies fL and fH. Moreover, the suppression control units 108*c* and 118*c* control the suppression units 103 and 113, respectively, so that signals in the corresponding frequency bands higher and lower than the derived cutoff frequency fD are suppressed.

In this way, in the present modification, the crossover frequencies fL and fH and the cutoff frequency fD are dynamically changed according to the acoustic signal. This allows speech to be clearer, and also allows the spatiality to be perceived more accurately.

In the present embodiment and first to third modifications, the hearing aid mode is switched by controlling the suppression units 103 and 113, that is to say, by determining whether or not to cause the suppression units 103 and 113 to perform suppression. However, the hearing aid mode may be switched by controlling the division units 102, 112, and 102*a*. To be more specific, the suppression control units 108 and 118 output the mode switching signals to the division units 102, 112, and 102*a*, instead of the suppression units 103 and 113. For example, when receiving the mode switching signal indicating switching to the dichotic-listening binaural hearing aid mode, the division unit 102 divides the acoustic signal into the signals in the three frequency bands as described above. Then, the division unit 102 outputs only the signal in the voice band to the suppression unit 103, and outputs the other two signals in the non-voice bands to the mixing unit 104. When the mode switching signal indicates switching to the normal hearing aid mode, the division unit 102 sends the acoustic signal to the mixing unit 104 without dividing the acoustic signal. The division unit 112 performs the same operation as the division unit 102. When receiving the mode switching signal indicating switching to the dichotic-listening binaural hearing aid mode, the division unit 102*a* divides the acoustic signal into the signals in the two frequency bands as described above. Then, the division unit 102*a* outputs only the signal in the voice band to the suppression unit 103, and outputs the other signal in the non-voice band to the mixing unit 104. When the mode switching signal indicates switching to the normal hearing aid mode, the division unit 102*a* sends the acoustic signal to the mixing unit 104 without dividing the acoustic signal. Accordingly, the switching processing performed by the suppression units 103 and 113 can be omitted, and a processing system can be shared between the dichotic-listening binaural hearing aid mode and the normal hearing aid mode.

Embodiment 2

As in the first embodiment, a hearing aid system in the present embodiment is capable of switching the hearing aid mode between the normal hearing aid mode and the dichotic-listening binaural hearing aid mode. When wishing to particularly clearly hear the voice of a person with whom the user is having a conversation for example, the user switches the hearing aid mode using an interface, such as a switch, of the hearing aid system in the present embodiment. When the hearing aid mode is switched to the dichotic-listening binaural hearing aid mode, the hearing aid system in the present embodiment performs the dichotic-listening binaural hearing aid processing. As a result, the user can hear the voice more clearly. As compared to the first embodiment, the hearing aid system in the present embodiment includes first and second band suppression units having configurations different from those in the first embodiment.

Figure 20:
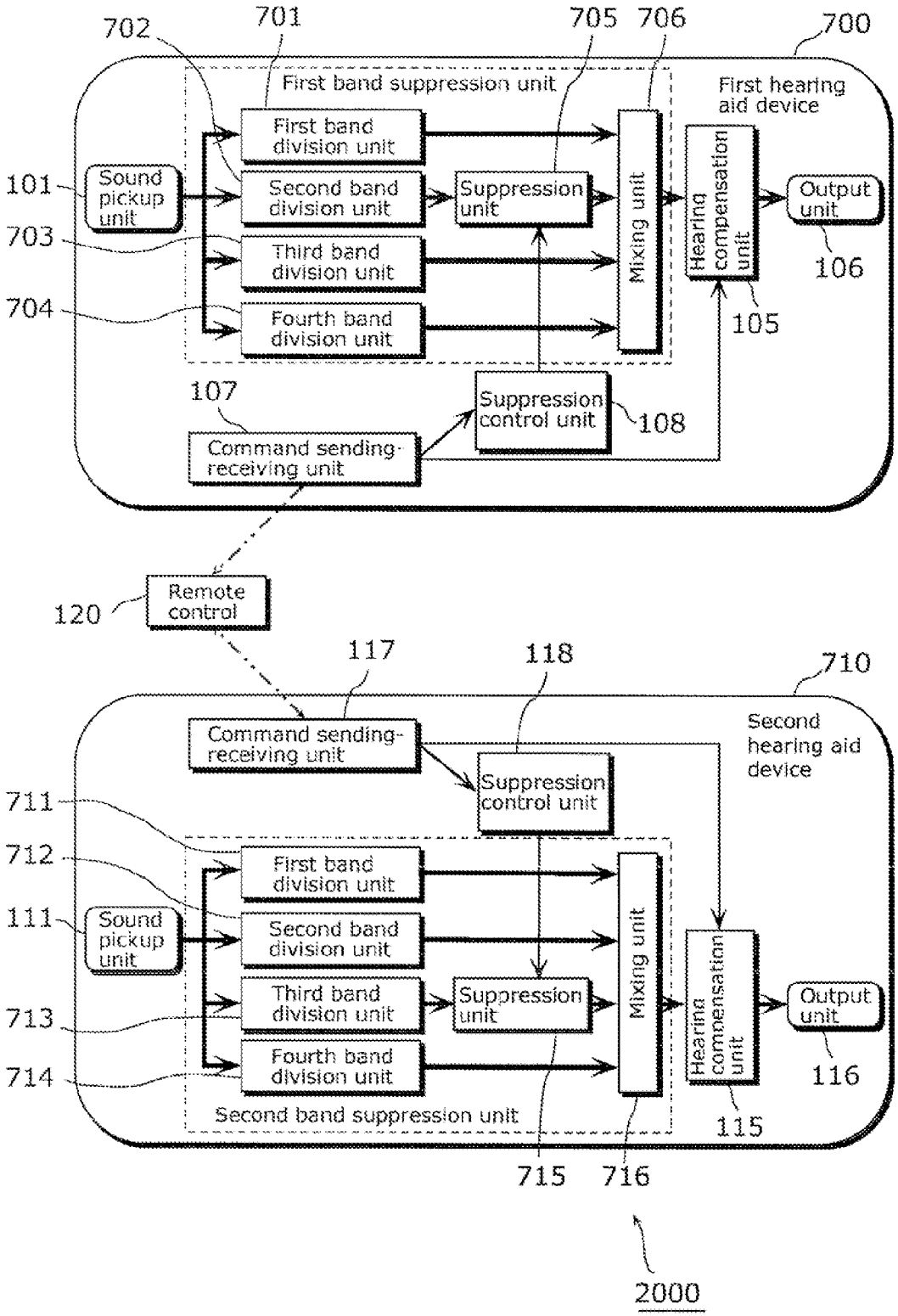
FIG. 20 is a functional block diagram of a hearing aid system in a second embodiment according to the present invention.

FIG. 20 is a functional block diagram of the hearing aid system in the present embodiment.

A hearing aid system 2000 in the present embodiment includes: first and second hearing aid devices 700 and 710; and a remote control 120. The first hearing aid device 700 is fitted on, for example, the left ear and the second hearing aid device 710 is fitted on, for example, the right ear. In the present embodiment, components identical to those in the first embodiment are assigned the same numerals used in the first embodiment and, therefore, the detailed explanations of these components are not repeated.

As with the first hearing aid device 100 in the first embodiment, the first hearing aid device 700 includes a sound pickup unit 101, a hearing compensation unit 105, an output unit 106, a command sending-receiving unit 107, and a suppression control unit 108. Unlike the first hearing aid device 100 in the first embodiment, the first hearing aid device 700 includes first to fourth band division units 701 to 704, a suppression unit 705, and a mixing unit 706 in place of the division unit 102, the suppression unit 103, and the mixing unit 104.

As with the first hearing aid device 110 in the first embodiment, the second hearing aid device 710 includes a sound pickup unit 111, a hearing compensation unit 115, an output unit 116, a command sending-receiving unit 117, and a suppression control unit 118. Unlike the second hearing aid device 110 in the first embodiment, the second hearing aid device 710 includes first to fourth band division units 711 to 714, a suppression unit 715, and a mixing unit 716 in place of the division unit 112, the suppression unit 113, and the mixing unit 114. In this way, the hearing aid system 2000 in the present embodiment includes the first and second band suppression units having the configurations different from those in the first embodiment.

Each of the first to fourth band division units 701 to 704 obtains an acoustic signal from the sound pickup unit 101, and divides the acoustic signal according to a corresponding preset frequency band. To be more specific, each of the first to fourth band division units 701 to 704 extracts and outputs a signal in the corresponding preset frequency band. Here, suppose that the crossover frequencies fL and fH and the cutoff frequency fD satisfy the relationship expressed as $fL<fD<fH$. In this case, the first band division unit 701 extracts a signal in a frequency band which is lower than the crossover frequency fL or which is equal to or lower than the crossover frequency fL. The second band division unit 702 extracts a signal in a frequency band from the crossover frequency fL to the cutoff frequency fD. The third band division unit 703 extracts a signal in a frequency band from the cutoff frequency fD to the crossover frequency fH. The fourth band division unit 704 extracts a signal in a frequency band which is higher than the crossover frequency fH or which is equal to or higher than the crossover frequency fH.

Also, the first to fourth band division units 711 to 714 of the second hearing aid device 710 are similar in construction to the first to fourth band division units 701 to 704 of the first hearing aid device 700, respectively.

When receiving, from the suppression control unit 108, the mode switching signal indicating switching to the dichotic-listening binaural hearing aid mode, the suppression unit 705 of the first hearing aid device 700 suppresses the signal extracted by and outputted from the second band division unit 702. On the other hand, when receiving, from the suppression control unit 108, the mode switching signal indicating switching to the normal hearing aid mode, the suppression unit 705 sends, to the mixing unit 706, the signal extracted by and outputted from the second band division unit 702 without suppressing this signal.

Also, when receiving, from the suppression control unit 118, the mode switching signal indicating switching to the dichotic-listening binaural hearing aid mode, the suppression unit 715 of the second hearing aid device 710 suppresses the signal extracted by and outputted from the third band division unit 713. On the other hand, when receiving, from the suppression control unit 118, the mode switching signal indicating switching to the normal hearing aid mode, the suppression unit 715 sends, to the mixing unit 716, the signal extracted by and outputted from the third band division unit 713 without suppressing this signal.

In short, when the hearing aid system 2000 executes the hearing aid processing in the normal hearing aid mode, the signal outputted from the second band division unit 702 of the first hearing aid device 700 to the suppression unit 705 is sent to the mixing unit 706 without gain control such as setting the gain at, for example, 1× gain. Similarly, the signal outputted from the third band division unit 713 of the second hearing aid device 710 to the suppression unit 715 is sent to the mixing unit 716 without gain control.

When the hearing aid system 2000 executes the hearing aid processing in the dichotic-listening binaural hearing aid mode, the suppression unit 705 of the first hearing aid device 700 attenuates the signal outputted from the second band division unit 702 according to the control signal from the suppression control unit 108. Similarly, the suppression unit 715 of the second hearing aid device 710 attenuates the signal outputted from the third band division unit 713 according to the control signal from the suppression control unit 118.

The mixing unit 706 of the first hearing aid device 700 mixes the signals outputted from the first band division unit 701, the third band division unit 703, and the fourth band division unit 704 and the signal outputted from the suppression unit 705. Then, the mixing unit 706 outputs the signal generated by the mixing as the acoustic signal or the suppressed acoustic signal. Also, the mixing unit 716 of the second hearing aid device 710 mixes the signals outputted from the first band division unit 711, the second band division unit 712, and the fourth band division unit 714 and the signal outputted from the suppression unit 715. Then, the mixing unit 716 outputs the signal generated by the mixing as the acoustic signal or the suppressed acoustic signal.

Figure 21:
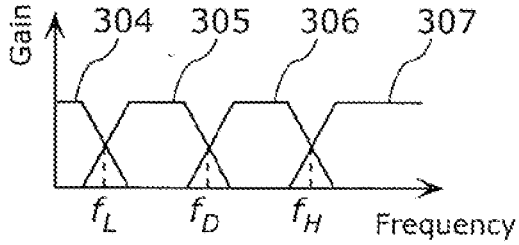
FIG. 21 is a diagram showing gain-frequency characteristics of first to fourth band division units in the second embodiment according to the present invention.

FIG. 21 is a diagram showing gain-frequency characteristics of the first to fourth band division units 701 to 704.

As shown by a solid line 304 in FIG. 21, the first band division unit 701 sets the gain higher (1× gain, for example) for the frequency band which is lower than the crossover frequency fL or which is equal to or lower than the crossover frequency fL, and sets the gain lower (about 0× gain, for example) for other frequency bands.

As shown by a solid line 305 in FIG. 21, the second band division unit 702 sets the gain higher (1× gain, for example) for the frequency band from the crossover frequency fL to the cutoff frequency fD, and sets the gain lower (about 0× gain, for example) for other frequency bands.

As shown by a solid line 306 in FIG. 21, the third band division unit 703 sets the gain higher (1× gain, for example) for the frequency band from the cutoff frequency fD to the crossover frequency fL, and sets the gain lower (about 0× gain, for example) for other frequency bands.

As shown by a solid line 307 in FIG. 21, the fourth band division unit 704 sets the gain higher (1× gain, for example) for the frequency band which is higher than the crossover frequency fH or which is equal to or higher than the crossover frequency fH, and sets the gain lower (about 0× gain, for example) for other frequency bands.

In this way, the first to fourth band division units 701 to 704 set the gains so that the acoustic signal is adequately divided. The crossover frequency fL of the first band division unit 701 and the second band division unit 702 is set at, for example, 200 Hz which is lower than the first formant frequency of speech. The cutoff frequency fD of the second band division unit 702 and the third band division unit 703 is set at, for example, 1250 Hz which is higher than the first formant frequency of speech and lower than the second so formant frequency of speech. The crossover frequency fH of the third band division unit 703 and the fourth band division unit 704 is set at, for example, 4 kHz, which is higher than the second formant frequency of speech. Thus, the first to fourth band division units 701 to 704 divide the acoustic signal into: a signal including many non-voice components in a low frequency band; a signal including the first formant components of speech; a signal including the second formant components of speech; and a signal including the non-voice components in a high frequency band and the speech components relatively less affected by the masking of the first formant frequency. It should be noted that gain characteristics of the first to fourth band division units 711 to 714 are set the same as those of the first to fourth band division units 701 to 704 as shown in FIG. 21.

Figure 22:
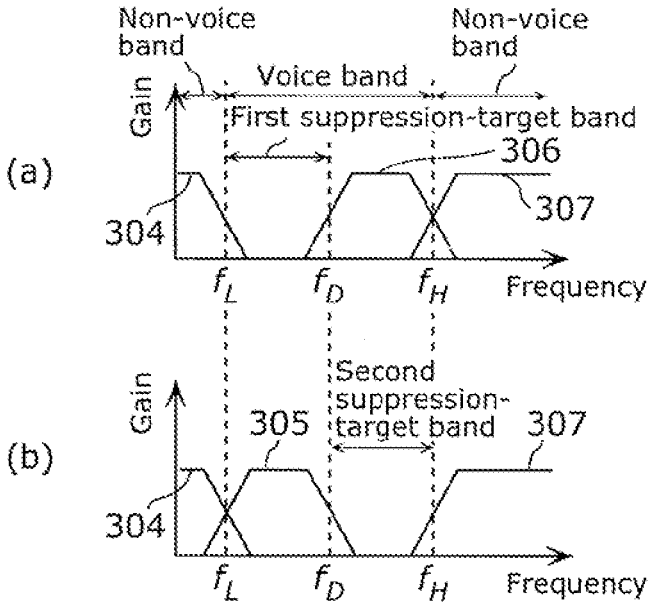
FIG. 22 is a conceptual diagram showing gain-frequency characteristics of first and second band suppression units included in the hearing aid system in the second embodiment according to the present invention.

FIG. 22 is a conceptual diagram showing gain-frequency characteristics of the first and second band suppression units included in the hearing aid system 2000.

In the dichotic-listening binaural hearing aid mode, the suppression unit 705 of the first hearing aid device 700 suppresses the signal outputted from the second band division unit 702. Thus, the gain of the first band suppression unit is set lower in the frequency band from the crossover frequency fL to the cutoff frequency fD (i.e., the first suppression-target band) as shown in (a) of FIG. 22, according to the gain control by the first to fourth band division units 701 to 704, the suppression unit 705, and the mixing unit 706.

In the dichotic-listening binaural hearing aid mode, the suppression unit 715 of the second hearing aid device 710 suppresses the signal outputted from the third band division unit 713. Thus, the gain of the second band suppression unit is set lower in the frequency band from the cutoff frequency fD to the crossover frequency fL (i.e., the second suppression-target band) as shown in (b) of FIG. 22, according to the gain control by the first to fourth band division units 711 to 714, the suppression unit 715, and the mixing unit 716.

Here, each of the gains applied to the signals outputted from the suppression units 103 and 113 in the first embodiment is calculated by multiplying the gain indicated by the solid line 302 in FIG. 11 by the corresponding gain shown in FIG. 12A or 128. Thus, the gains applied to the signals outputted from the suppression units 103 and 113 in the first embodiment agree respectively with the gains, indicated by the solid lines 306 and 305 in FIG. 22, applied to the signals outputted from the third band division unit 703 and the second band division unit 712 in the present embodiment. Moreover, the gain indicated by the solid line 301 of FIG. 11 in the first embodiment is equal to the gain indicated by the solid line 304 of FIG. 22 in the present embodiment. Furthermore, the gain indicated by the solid line 303 of FIG. 11 in the first embodiment is equal to the gain indicated by the solid line 307 of FIG. 22 in the present embodiment. That is, the gains indicated by the solid lines 301 and 303 in FIG. 11 applied to each of the signals bypassing the suppression units 103 and 113 in the first embodiment have characteristics represented by the gains indicated by the solid lines 304 and 307 in FIG. 22 in the present embodiment. Thus, a characteristic of the first hearing aid device 100 presenting the high frequency sounds in the first embodiment is represented by an addition of the gains indicated by the solid lines 304, 306, and 307 as shown in (a) of FIG. 22 in the present embodiment. Also, a characteristic of the second hearing aid device 110 presenting the low frequency sounds in the first embodiment is represented by an addition of the gains indicated by the solid lines 304, 305, and 307 as shown in (b) of FIG. 22 in the present embodiment.

Next, a series of operations performed by the hearing aid system 2000 of the present embodiment in the dichotic-listening binaural hearing aid processing (i.e., the dichotic-listening binaural hearing aid mode) is described.

Figure 23:
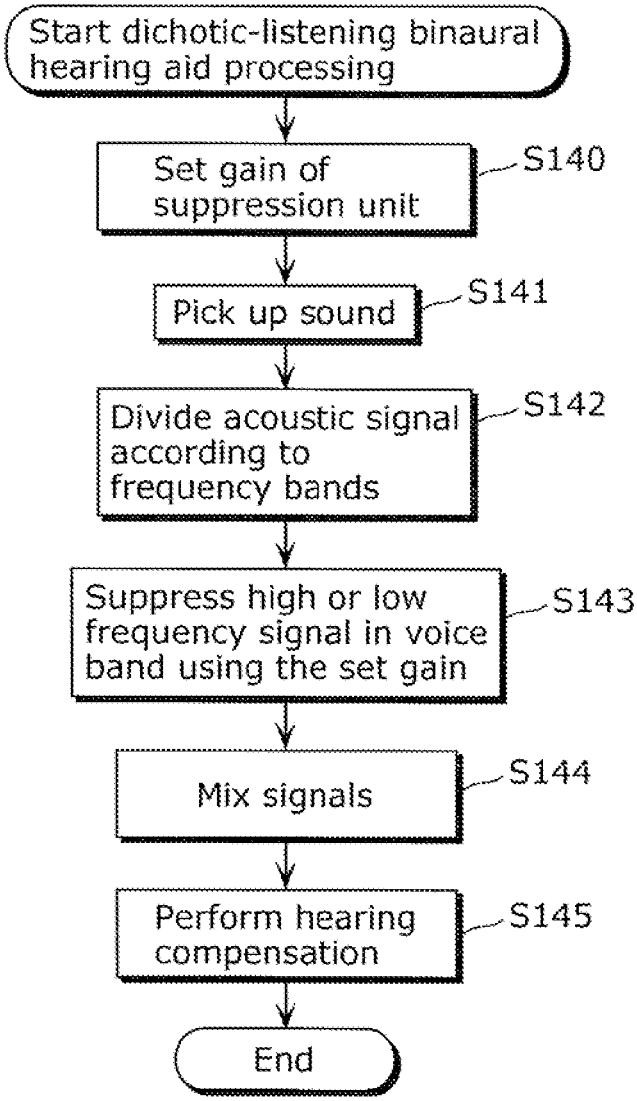
FIG. 23 is a flowchart showing dichotic-listening binaural hearing aid processing performed by a first hearing aid device 700 included in the hearing aid system in the second embodiment according to the present invention.

FIG. 23 is a flowchart showing the dichotic-listening binaural hearing aid processing performed by the first hearing aid device 700 included in the hearing aid system 2000. It should be noted that the second hearing aid device 710 performs the same dichotic-listening binaural hearing aid processing as shown in FIG. 23.

Firstly, when the mode switching command received by the command sending-receiving unit 107 indicates the dichotic-listening binaural hearing aid mode, the suppression control unit 108 sets the gain of the suppression unit 705 (about 0× gain, for example) so as to suppress the signal, out of the acoustic signal, in the frequency band corresponding to the second band division unit 702 (step S140).

Next, the sound pickup unit 101 of the first hearing aid device 700 picks up an ambient sound, and sends an acoustic signal generated from the picked-up sound to the first to fourth band division units 701 to 704 (step S141). The first to fourth band division units 701 to 704 divide the acoustic signal according to the respective frequency bands (step S142). Here, the first to fourth band division units 701 to 704 may perform filter processing for each sample of the acoustic signal, or may perform the Fourier transform for each set of samples (128 samples, for example) to divide the acoustic signal in the frequency domain. Following this, the suppression unit 705 suppresses the signal outputted from the second band division unit 702 (the signal in the high or low frequency band in the voice band), using the gain set by the suppression control unit 108 in step S140 (step S143). The mixing unit 706 mixes this suppressed signal and the signals outputted from the first band division unit 701, the third band division unit 703, and the fourth band division unit 704 (step S144). The mixed signal is sent, as the suppressed acoustic signal, to the hearing compensation unit 105. The hearing compensation unit 105 performs hearing compensation on the suppressed acoustic signal, and causes the output unit 106 to output the sound indicated by the hearing-compensated suppressed acoustic signal (step S145).

Next, control to switch between the hearing aid modes is explained. When wishing to more clearly hear the voice of a person with whom the user is having a conversation for example, the user operates the remote control 120 to enable the hearing aid system 2000 to perform the dichotic-listening binaural hearing aid processing. The remote control 120 sends a signal corresponding to the operation, as a command (i.e., the mode switching command), to the first and second hearing aid devices 700 and 710. Each of the command sending-receiving units 107 and 117 of the first and second hearing aid devices 700 and 710 receives this command. Each of the command sending-receiving units 107 and 117 sends the command to the corresponding suppression control unit 108 or 118. Receiving the command, each of the suppression control units 108 and 118 sends, to the corresponding suppression unit 705 or 715, the mode switching signal indicating switching to the dichotic-listening binaural hearing aid mode to control the operation performed by the suppression unit 705 or 715. By these operations thus far, the hearing aid mode is switched from the normal hearing aid mode to the dichotic-listening binaural hearing aid mode in the present embodiment as in the first embodiment.

Instead of operating the remote control 120, the user may operate the switches 109 and 119 included in the main units of the first and second hearing aid devices 700 and 710, respectively, in the present embodiment as in the first embodiment. In this case, when wishing to hear more clearly the voice of the person the user is talking to, the user operates the switches 109 and 119 to enable the hearing aid system 2000 to perform the dichotic-listening binaural hearing aid processing. Then, each of the command sending-receiving units 107 and 117 receives a signal corresponding to this operation. Accordingly, the same processing as performed by the remote control 120 for switching the hearing aid mode is performed. In this case, by operating only the switch 109 or 119 of the corresponding hearing aid device 700 or 710 for one of the ears, not only the hearing aid mode of the hearing aid device corresponding to this ear is switched, but the hearing aid modes of the hearing aid devices 700 and 710 for both ears may be switched to the same hearing aid mode. For example, the first and second hearing aid devices 700 and 710 are connected via a wireless communication medium. Then, when the hearing aid mode is switched using the switch included in one of the hearing aid devices, the corresponding one of the command sending-receiving units 107 or 117 of the hearing aid device sends a control signal indicating switching of the hearing aid mode to the other one of the command sending-receiving unit 117 or 107. Moreover, when the hearing aid mode is switched from the dichotic-listening binaural hearing aid mode to the normal hearing aid mode, control is executed via the remote control 120 or the switches 109 and 119 as described above.

As described thus far, the first and second hearing aid devices 700 and 710 of the hearing aid system in the present embodiment are capable of outputting the sounds having the same frequency responses as in the case of the first embodiment. As a result, as in the case of the first embodiment, the user can perceive the sounds, spatially distinguishing among the desired speech of the source source 602 and the ambient noises L and R of the sound sources 603 and 604 shown in FIG. 4. Thus, the clarity of speech (i.e., noise immunity) can be increased. Moreover, the user can hear in natural stereo, the ambient noise in the frequency band lower than speech by both ears, instead of one ear. This can reduce a feeling of exhaustion of the hearing-impaired person more, as compared to the conventional method by which the low frequency sound is presented to only one ear. Furthermore, the user can hear, in stereo, the alarm sound, such as a bell sound, in the high frequency band higher than speech by both ears. This allows the user to perceive the direction of the alarm sound or the location of the sound source 605 of the alarm sound, and thus to perceive the direction from which the alarm sound is approaching.

In the present embodiment, the dichotic-listening binaural hearing aid processing is performed using the first and second band suppression units independent of the hearing compensation units 105 and 115, respectively. Here, the first band suppression unit includes the first to fourth band division units 701 to 704, the suppression unit 705, and the mixing unit 706, and the second band suppression unit includes the first to fourth band division units 711 to 714, the suppression unit 715, and the mixing unit 716. The dichotic-listening as binaural hearing aid processing may be performed using the hearing compensation units 105 and 115. Many of recent hearing aid systems divide an acoustic signal into a plurality of frequency bands to perform the hearing aid processing. Such a hearing aid system may include a hearing compensation unit which has an internal processing function corresponding to the functions of the first to fourth band division units 701 to 704. In the case where each of the hearing compensation units 105 and 115 has this processing function, the hearing compensation units 105 and 115 may control the gain for each frequency band, in place of the first and second band suppression units, to implement the same function of the dichotic-listening binaural hearing aid processing as in the present embodiment.

Moreover, in the case where the hearing compensation unit 105 is located before the mixing unit 706 and has an internal processing function of controlling the gain for each frequency band, the hearing compensation unit 105 may have a function as the suppression unit 705. To be more specific, the hearing compensation unit 105 receives the signals in the corresponding frequency bands outputted from the first to fourth band division units 701 to 704, performs hearing compensation on the signal for each of the frequency bands using an internal parameter, and outputs the hearing-compensated signal for each of the frequency bands to the mixing unit 706. Here, the hearing compensation unit 105 changes the internal parameter corresponding to the signal outputted from the second band division unit 702 to suppress this signal. The hearing compensation unit 115 performs the same processing as the hearing compensation unit 105.

(Modification)

Here, the modification in the present embodiment is described. In the present modification, each of first and second hearing aid devices included in a hearing aid system divides an acoustic signal into signals in three frequency bands, instead of dividing the acoustic signal into signals in the four frequency bands as in the above embodiment.

Figure 24:
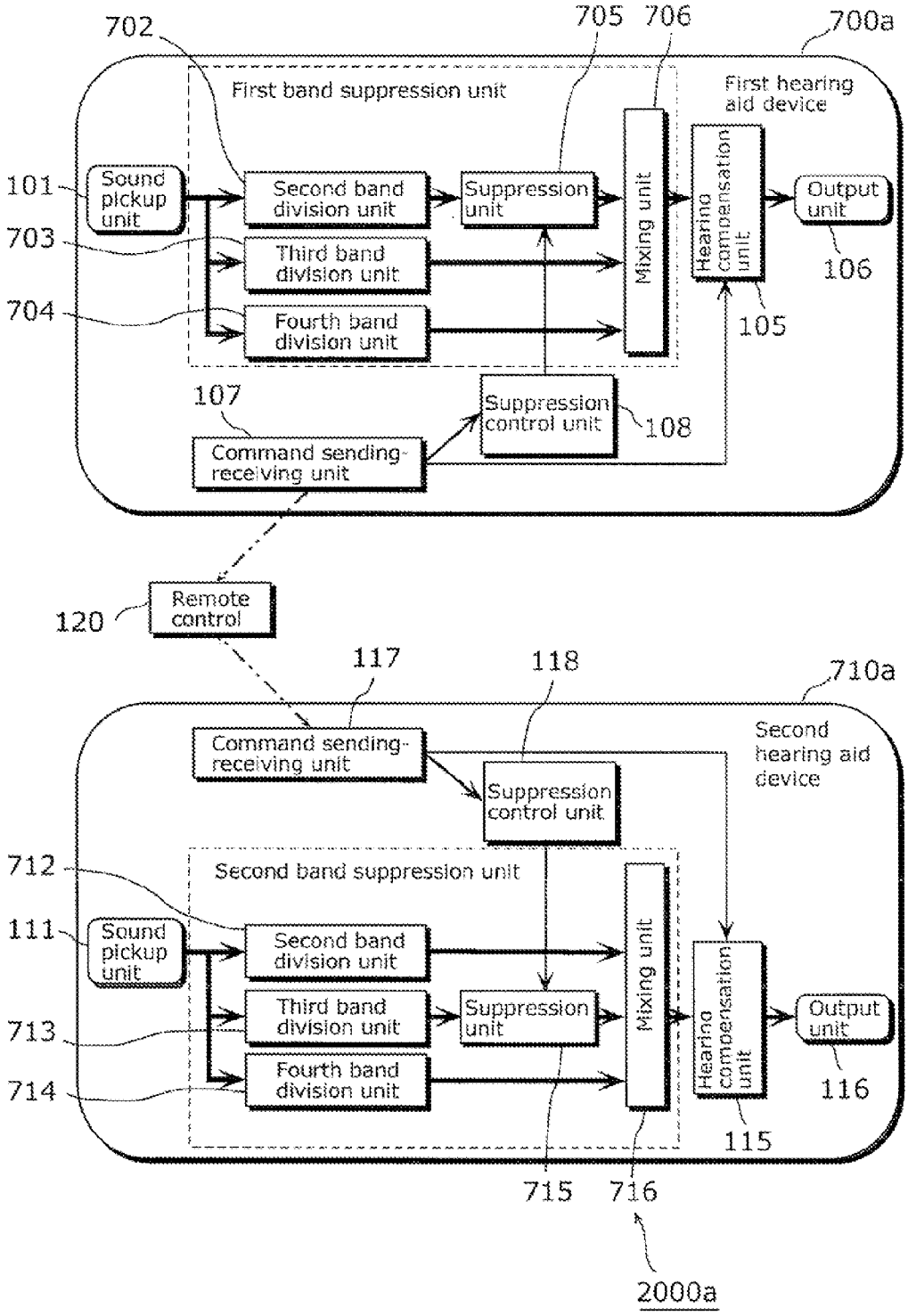
FIG. 24 is a functional block diagram of a hearing aid system in a modification of the second embodiment according to the present invention.

FIG. 24 is a functional block diagram of the hearing aid system in the present modification.

A hearing aid system **2000*a* in the present modification includes: first and second hearing aid devices 700*a* and 710*a*; and a remote control 120**.

The first hearing aid device **700*a* includes a sound pickup unit 101, second to fourth band division units 702 to 704, a suppression unit 705, a mixing unit 706, a hearing compensation unit 105, an output unit 106, a command sending-receiving unit 107, and a suppression control unit 108. The second hearing aid device 710*a* includes a sound pickup unit 111, second to fourth band division units 712 to 714, a suppression unit 715, a mixing unit 716, a hearing compensation unit 115, an output unit 116, a command sending-receiving unit 117, and a suppression control unit 118. Unlike the first and second hearing aid devices 700 and 710 in the above embodiment, the first and second hearing aid devices 700*a* and 710*a* in the present modification do not include the first band division units 701 and 711**, respectively.

Figure 25:
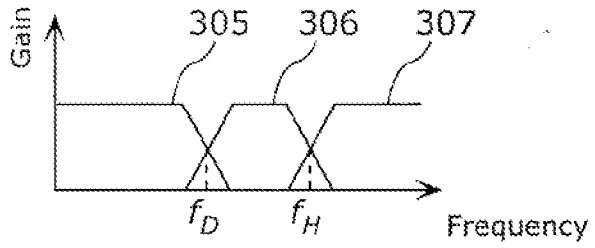
FIG. 25 is a diagram showing gain-frequency characteristics of second to fourth band division units in the modification of the second embodiment according to the present invention.

FIG. 25 is a diagram showing gain-frequency characteristics of second to fourth band division units 702 to 704.

As indicated by a solid line 305 in FIG. 25, the second band division unit 702 sets the gain higher (1× gain, for example) for the frequency band which is lower than the cutoff frequency fD or which is equal to or lower than the cutoff frequency fD, and sets the gain lower (about 0× gain, for example) for other frequency bands.

As shown by a solid line 306 in FIG. 25, the third band division unit 703 sets the gain higher (1× gain, for example) for the frequency band from the cutoff frequency fD to the crossover frequency fL, and sets the gain lower (about 0× gain, for example) for other frequency bands.

As shown by a solid line 307 in FIG. 25, the fourth band division unit 704 sets the gain higher (1× gain, for example) for the frequency band which is higher than the crossover frequency fH or which is equal to or higher than the crossover frequency fH, and sets the gain lower (about 0× gain, for example) for other frequency bands.

It should be noted that a relationship among the cutoff frequency fD, the crossover frequency fH, the first formant frequency f1, and the second formant frequency f2 is the same as in the above embodiment. Also note that the gain-frequency characteristics of the second to fourth band division units 712 to 714 are the same as those of the second to fourth band division units 702 to 704.

Figure 26:
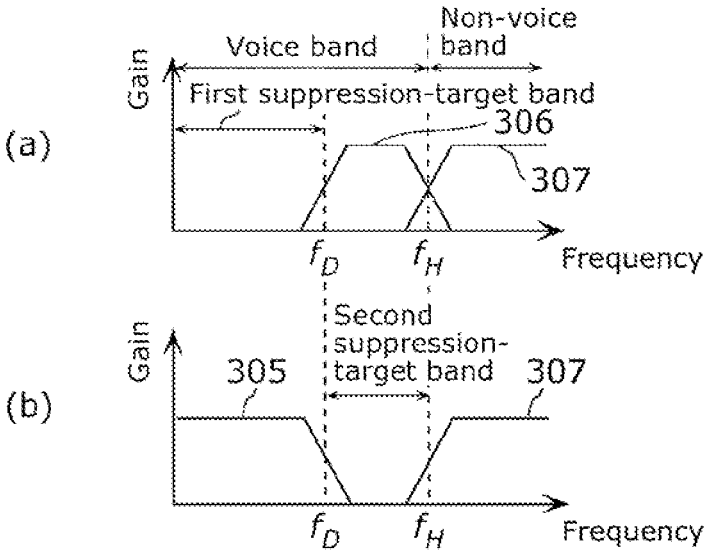
FIG. 26 is a conceptual diagram showing gain-frequency characteristics of first and second band suppression units included in is the hearing aid system in the modification of the second embodiment according to the present invention.

FIG. 26 is a conceptual diagram showing gain-frequency characteristics of the first and second band suppression units included in the hearing aid system 2000*a*.

In the dichotic-listening binaural hearing aid mode, the suppression unit 705 of the first hearing aid device 700*a* suppresses the signal outputted from the second band division unit 702. Thus, the gain of the first band suppression unit is set lower in the frequency band which is lower than the cutoff frequency fD or which is equal to or lower than the cutoff frequency fD (i.e., the first suppression-target band) as shown in (a) of FIG. 26, according to the gain control by the second to fourth band division units 702 to 704, the suppression unit 705, and the mixing unit 706.

In the dichotic-listening binaural hearing aid mode, the suppression unit 715 of the second hearing aid device 710*a* suppresses the signal outputted from the third band division unit 713. Thus, the gain of the second band suppression unit is set lower in the frequency band from the cutoff frequency fD to the crossover frequency fH (i.e., the second suppression-target band) as shown in (b) of FIG. 26, according to the gain control by the second to fourth band division units 712 to 714, the suppression unit 715, and the mixing unit 716.

In this way, in the present modification, the frequency band which is lower than the cutoff frequency fD or which is equal to or lower than the cutoff frequency fD is treated as the first suppression-target band. Then, in the dichotic-listening binaural hearing aid mode, the first hearing aid device 700*a* suppresses the signal in this frequency band. More specifically, the first suppression-target band suppressed by the first hearing aid device 700*a* is wider, in the direction of lower frequencies, than the first suppression-target band suppressed by the first hearing aid device 700 in the above embodiment. On account of this, by the dichotic-listening binaural hearing aid processing of the present modification, the user hears, in stereo, only the sound in the non-voice band higher than the voice band (i.e., the sound in the high non-voice band). Here, it is relatively hard even for a healthy person to hear, in stereo, the sound in the non-voice band lower than the voice band or the sound in the lower voice band shown in (a) of FIG. 22. Thus, in the case of the present modification where the signal in the first suppression-target band wider in the direction of lower frequencies is suppressed so that the sound in this band cannot be heard in stereo, a disadvantage to the user is relatively small. Therefore, the present modification can achieve the same advantageous effect as in the above embodiment. Moreover, since the first band division units 701 and 711 can be omitted in the present modification, the configuration and processing can be more simplified as compared to the above embodiment.

It should be noted that, in the present modification, the dichotic-listening binaural hearing aid processing may be performed using the functions of the hearing compensation units 105 and 115 as in the above embodiment.

Although the present invention has been described thus far based on the first and second embodiments and modifications thereof, the present invention is not limited to these embodiments and modifications.

For example, each of the hearing aid systems in the above first and second embodiments and modifications thereof includes the sound pickup unit configured with the microphone or the like. However, a terminal for obtaining an electrical signal from an external source or a receiver for wirelessly receiving the electrical signal from the external source may be included in place of the sound pickup unit. Alternatively, a component may be included which obtains electrical signals from an external device via a cable and wirelessly and then mixes these signals. Moreover, the output unit may be an earphone, a speaker, a headphone, a transducer such as a bone-conduction transducer, or an electrode for an inner ear. Furthermore, a cable communication medium, instead of a wireless communication medium, may be used for establishing communication between the remote control and the first and second hearing aid devices.

Also, the following cases are included in the present invention.

(1) Some or all of the components included in each of the above-described devices may be implemented as a computer system configured with a microprocessor, a ROM, a RAM, a hard disk unit, and so forth. In this case, the RAM or the hard disk unit stores a computer program for achieving the same operations performed by the above-described devices. The microprocessor operates according to the computer program, so that the functions of the devices are carried out. Here, note that the computer program includes a plurality of instruction codes indicating instructions to be given to the computer so as to achieve a specific function.

(2) Some or all of the components included in each of the above-described devices may be realized as a single system Large Scale Integration (LSI). The system LSI is a super multifunctional LSI manufactured by integrating a plurality of components onto a signal chip. To be more specific, the system LSI is a computer system configured with a microprocessor, a ROM, a RAM, and so forth. The RAM stores a computer program for achieving the same operations performed by the above-described devices. The microprocessor operates according to the computer program, so that the functions of the system LSI are carried out.

(3) Some or all of the components included in each of the above-described devices may be implemented as an IC card or a standalone module that can be inserted into and removed from the corresponding device. The IC card or the module is a computer system configured with a microprocessor, a ROM, a RAM, and so forth. The IC card or the module may include the aforementioned super multifunctional LSI. The microprocessor operates according to the computer program, so that the functions of the IC card or the module are carried out. The IC card or the module may be tamper resistant.

(4) The present invention may be methods implemented by the computer processes described above. Moreover, the present invention may be a computer program implemented by a computer executing these methods, or may be a digital signal of the computer program.

Moreover, the present invention may be the aforementioned computer program or digital signal recorded onto a computer-readable recording medium. Examples of the computer-readable recording medium include a flexible disk, a hard disk, a CD-ROM, an MO, a DVD, a DVD-ROM, a DVD-RAM, a Blu-ray Disc (BD), and a semiconductor memory. Also, the present invention may be the digital signal recorded onto these recording media.

Furthermore, the present invention may be the aforementioned computer program or digital signal transmitted via, for example, a telecommunication line, a wireless or wired communication line, a network represented by the Internet, and data broadcasting.

Also, the present invention may be a computer system including a microprocessor and a memory. The memory may store the aforementioned computer program and the microprocessor may operate according to the computer program.

Moreover, by transferring the recording medium having the aforementioned program or digital signal recorded thereon or by to transferring the aforementioned program or digital signal via the aforementioned network or the like, the present invention may be implemented by an independent different computer system.

(5) The above embodiments and modifications may be combined.

INDUSTRIAL APPLICABILITY

The hearing aid system and hearing aid method according to the present invention have an advantageous effect of allowing the user to spatially perceive an environmental sound (i.e., an ambient sound) while improving the clarity of speech. The present invention is useful as a hearing aid, audio equipment, a cellular phone, and devices in general used for audio reproduction, such as public addressing, or for verbal communication

REFERENCE SIGNS LIST

| | |
|---|---|
| 100, 100b, 100c, 700, 700a | First hearing aid device |
| 110, 110b, 110c, 710, 710a | Second hearing aid device |
| 101, 111 | Sound pickup unit |
| 102, 112 | Division unit |
| 103, 113 | Suppression unit |
| 104, 114 | Mixing unit |
| 105, 115 | Hearing compensation unit |
| 106, 116 | Output unit |
| 107, 117 | Command sending-receiving unit |
| 108, 108c, 118, 118c | Suppression control unit |
| 120 | Remote control |
| 201 | LPF |
| 202 | BPF |
| 203 | HPF |
| 901 | APF |
| 902 | BPF |
| 903 | Subtraction unit |
| 701, 711 | First band division unit |
| 702, 712 | Second band division unit |
| 703, 713 | Third band division unit |
| 704, 714 | Fourth band division unit |
| 705, 715 | Suppression unit |
| 706, 716 | Mixing unit |
| 1000, 1000a to 1000c, 2000, 2000a | Hearing aid system |
| 1100 | First hearing aid device |
| 1100 | Sound pickup unit |
| 1120 | Output unit |
| 1200 | Second hearing aid device |
| 1210 | Sound pickup unit |
| 1220 | Output unit |
| 1300 | First band suppression unit |
| 1400 | Second band suppression unit |

The invention claimed is:

1. A hearing aid system comprising a first hearing aid device and a second hearing aid device, each of said first hearing aid device and said second hearing aid device including:

a sound pickup unit configured to pick up a sound and output an acoustic signal indicating the picked-up sound; and an output unit configured to output a sound indicated by a suppressed acoustic signal generated by suppression performed on a signal in a certain frequency band out of frequency bands of the sound indicated by the acoustic signal, the frequency bands of the sound indicated by the acoustic signal including: a voice band which is a frequency band having a vocal component; and a non-voice band other than the voice band, the voice band including a first suppression-target band and a second suppression-target band which are frequency bands different from each other, said hearing aid system comprising:

a first band suppression unit configured to generate the suppressed acoustic signal indicating the sound outputted from said output unit of said first hearing aid device, by suppressing a signal in the first suppression-target band out of the acoustic signal outputted from said sound pickup unit of said first hearing aid device; and a second band suppression unit configured to generate the suppressed acoustic signal indicating the sound outputted from said output unit of said second hearing aid device, by suppressing a signal in the second suppression-target band out of the acoustic signal outputted from said sound pickup unit of said second hearing aid device, wherein said first band suppression unit includes:

a first division unit configured to divide the acoustic signal outputted from said sound pickup unit of said first hearing aid device into: a signal in a low non-voice band which is lower in frequency than the voice band and which is included in the non-voice band; a signal in the voice band; and a signal in a high non-voice band which is higher in frequency than the voice band and which is included in the non-voice band;

a first suppression unit configured to suppress the signal in the first suppression-target band, out of the signal in the voice band generated by the division performed by said first division unit; and a first mixing unit configured to generate the suppressed acoustic signal indicating the sound outputted from said output unit of said first hearing aid device, by mixing the signal in the voice band suppressed by said first suppression unit, the signal in the low non-voice band, and the signal in the high non-voice band, and the suppressed acoustic signals indicating the sounds outputted respectively from said output units of said first hearing aid device and said second hearing aid device include, in common, a signal in the non-voice band included in the acoustic signal.

2. The hearing aid system according to claim 1, wherein said second band suppression unit includes:

a second division unit configured to divide the acoustic signal outputted from said sound pickup unit of said second hearing aid device into a signal in the voice band and the signal in the non-voice band;

a second suppression unit configured to suppress the signal in the second suppression-target band, out of the signal in the voice band generated by the division performed by said second division unit; and a second mixing unit configured to generate the suppressed acoustic signal indicating the sound outputted from said output unit of said second hearing aid device, by mixing the signal in the voice band suppressed by said second suppression unit and the signal in the non-voice band.

3. The hearing aid system according to claim 2, wherein an upper limit frequency in the low non-voice band is 200 Hz or higher, and lower than 2500 Hz, a lower limit frequency in the high non-voice band is 2500 Hz or higher, and a boundary frequency between the first suppression-target band and the second suppression-target band is present between the upper limit frequency and the lower limit frequency.

4. The hearing aid system according to claim 3, wherein the boundary frequency is higher than a first formant frequency of speech indicated by the acoustic signal outputted from said sound pickup unit and lower than a second formant frequency of the speech, the upper limit frequency is lower than the first formant frequency, and the lower limit frequency is higher than the second formant frequency.

5. The hearing aid system according to claim 4, wherein said first hearing aid device further includes:

a formant calculation unit configured to calculate each of the first formant frequency and the second formant frequency, based on the acoustic signal outputted from said sound pickup unit of said first hearing aid device; and a suppression control unit configured to set the upper limit frequency, the lower limit frequency, and the boundary frequency for each of said first division unit and said first suppression unit, based on the first formant frequency and the second formant frequency calculated by said formant calculation unit.

6. The hearing aid system according to claim 2, wherein said first division unit includes:

a band-pass filter which separates the signal in the voice band from the acoustic signal, by passing only the signal in the voice band out of the acoustic signal outputted from said sound pickup unit of said first hearing aid device; and a subtraction unit configured to separate the signal in the non-voice band from the acoustic signal, by subtracting the signal in the voice band from the acoustic signal.

7. The hearing aid system according to claim 2, wherein said first division unit is configured to divide the acoustic signal outputted from said sound pickup unit of said first hearing aid device into: the signal in the low non-voice band which is lower in frequency than the voice band and which is included in the non-voice band; the signal in the first suppression-target band; the signal in the second suppression-target band; and the signal in the high non-voice band which is higher in frequency than the voice band and which is included in the non-voice band, and said first mixing unit is configured to mix the signal in the low non-voice band, the signal in the first suppression-target band suppressed by said first suppression unit, the signal in the second suppression-target band, and the signal in the high non-voice band.

8. The hearing aid system according to claim 2, wherein said first division unit is configured to divide the acoustic signal outputted from said sound pickup unit of said first hearing aid device into: the signal in the first suppression-target band; the signal in the second suppression-target band; and the signal in the high non-voice band which is higher in frequency than the voice band, and said first mixing unit is configured to mix the signal in the first suppression-target band suppressed by said first suppression unit, the signal in the second suppression-target band, and the signal in the non-voice band.

9. The hearing aid system according to claim 1, further comprising an operation receiving unit configured to receive an operation performed to switch a hearing aid mode between a first hearing aid mode and a second hearing aid mode, wherein, when said operation receiving unit receives the operation to switch the hearing aid mode to the first hearing aid mode, said first and second band suppression units are configured to generate the suppressed acoustic signals indicating the sounds outputted from said output units of said first and second hearing aid devices, respectively, and when said operation receiving unit receives the operation to switch the hearing aid mode to the second hearing aid mode, said first and second band suppression units are configured not to suppress the acoustic signals and said output units of said first and second hearing aid devices are configured to output the sounds indicated by the acoustic signals which is not suppressed by said first and second band suppression units, respectively.

10. The hearing aid system according to claim 9, wherein, when receiving the operation, said operation receiving unit is configured to send, to each of the first and second hearing aid devices, a mode switching command indicating the operation, said first hearing aid device includes:

said first band suppression unit;

a first command sending-receiving unit configured to receive the mode switching command; and a first suppression control unit configured to control said first band suppression unit according to the mode switching command received by said first command sending-receiving unit, and said second hearing aid device includes:

said second band suppression unit;

a second command sending-receiving unit configured to receive the mode switching command; and a second suppression control unit configured to control the second band suppression unit according to the mode switching command received by said second command sending-receiving unit.

11. The hearing aid system according to claim 10, wherein, when receiving the operation, said operation receiving unit is configured to send a mode-switching verification command to each of said first and second hearing aid devices and to send the mode switching command to each of said first and second hearing aid devices only when receiving an acknowledgment signal from each of said first and second hearing aid devices in response to the sent mode-switching verification command, and when receiving the mode-switching verification command, each of said first and second command sending-receiving units is configured to send the acknowledgment signal.

12. A hearing aid method of performing hearing aid processing on a sound picked up by each of a first hearing aid device and a second hearing aid device, frequency bands of the sound including: a voice band which is a frequency band having a vocal component; and a non-voice band other than the voice band, the voice band including a first suppression-target band and a second suppression-target band which are frequency bands different from each other, said hearing aid method comprising:

picking up a sound and outputting an acoustic signal indicating the picked-up sound, by each of the first and second hearing aid devices;

generating a suppressed acoustic signal indicating the sound outputted from the first hearing aid device, by suppressing a signal in the first suppression-target band out of the acoustic signal outputted from the first hearing aid device in said picking up;

generating a suppressed acoustic signal indicating the sound outputted from the second hearing aid device, by suppressing a signal in the second suppression-target band out of the acoustic signal outputted from the second hearing aid device in said picking up; and outputting sounds indicated respectively by the suppressed acoustic signals generated in said generatings, by the first and second hearing aid devices, wherein said generating by the first hearing aid device includes:

dividing the acoustic signal outputted in said picking up by the first hearing aid device into: a signal in a low non-voice band which is lower in frequency than the voice band and which is included in the non-voice band; a signal in the voice band; and a signal in a high non-voice band which is higher in frequency than the voice band and which is included in the non-voice band;

suppressing the signal in the first suppression-target band, out of the signal in the voice band generated in said dividing; and generating the suppressed acoustic signal indicating the sound outputted in said outputting by the first hearing aid device, by mixing the signal in the voice band suppressed in said suppressing, the signal in the low non-voice band, and the signal in the high non-voice band, and the suppressed acoustic signals indicating the sounds outputted respectively from the first and second hearing aid devices include, in common, a signal in the non-voice band included in the acoustic signal.

13. A computer program for a hearing aid system including a first hearing aid device and a second hearing aid device, said computer program being recorded on a non-transitory computer-readable recording medium for use in a computer, each of the first hearing aid device and the second hearing aid device having:

a sound pickup unit configured to pick up a sound and output an acoustic signal indicating the picked-up sound; and an output unit configured to output a sound indicated by a suppressed acoustic signal generated by suppression performed on a signal in a certain frequency band out of frequency bands of the sound indicated by the acoustic signal, the frequency bands of the sound indicated by the acoustic signal including: a voice band which is a frequency band having a vocal component; and a non-voice band other than the voice band, the voice band including a first suppression-target band and a second suppression-target band which are frequency bands different from each other, said computer program causing the computer to execute:

generating the suppressed acoustic signal indicating the sound outputted from the output unit of the hearing aid device, by suppressing a signal in the first suppression-target band out of the acoustic signal outputted from the sound pickup unit of the first hearing aid device; and generating the suppressed acoustic signal indicating the sound outputted from the output unit of the second hearing aid device, by suppressing a signal in the second suppression-target band out of the acoustic signal outputted from the sound pickup unit of the second hearing aid device, wherein said generating by the first hearing aid device includes:

dividing the acoustic signal outputted from the sound pickup unit of the first hearing aid device into: a signal in a low non-voice band which is lower in frequency than the voice band and which is included in the non-voice band; a signal in the voice band; and a signal in a high non-voice band which is higher in frequency than the voice band and which is included in the non-voice band;

suppressing the signal in the first suppression-target band, out of the signal in the voice band generated in said dividing; and generating the suppressed acoustic signal indicating the sound outputted from the output unit of the first hearing aid device, by mixing the signal in the voice band suppressed in said suppressing, the signal in the low non-voice band, and the signal in the high non-voice band, and the suppressed acoustic signals indicating the sounds outputted respectively from the output units of the first and second hearing aid devices include, in common, a signal in the non-voice band included in the acoustic signal.

14. An integrated circuit used in a hearing aid system including a first hearing aid device and a second hearing aid device, each of said first hearing aid device and said second hearing aid device having:

a sound pickup unit configured to pick up a sound and output an acoustic signal indicating the picked-up sound; and an output unit configured to output a sound indicated by a suppressed acoustic signal generated by suppression performed on a signal in a certain frequency band out of frequency bands of the sound indicated by the acoustic signal, the frequency bands of the sound indicated by the acoustic signal including: a voice band which is a frequency band having a vocal component; and a non-voice band other than the voice band, the voice band including a first suppression-target band and a second suppression-target band which are frequency bands different from each other, said integrated circuit comprising:

a first band suppression unit configured to generate the suppressed acoustic signal indicating the sound outputted from said output unit of said first hearing aid device, by suppressing a signal in the first suppression-target band out of the acoustic signal outputted from said sound pickup unit of said first hearing aid device; and a second band suppression unit configured to generate the suppressed acoustic signal indicating the sound outputted from said output unit of said second hearing aid device, by suppressing a signal in the second suppression-target band out of the acoustic signal outputted from said sound pickup unit of said second hearing aid device, wherein said first band suppression unit includes:

a division unit configured to divide the acoustic signal outputted from said sound pickup unit of said first hearing aid device into: a signal in a low non-voice band which is lower in frequency than the voice band and which is included in the non-voice band; a signal in the voice band; and a signal in a high non-voice band which is higher in frequency than the voice band and which is included in the non-voice band;

a suppression unit configured to suppress the signal in the first suppression-target band, out of the signal in the voice band generated by the division performed by said division unit; and a mixing unit configured to generate the suppressed acoustic signal indicating the sound outputted from said output unit of said first hearing aid device, by mixing the signal in the voice band suppressed by said suppression unit, the signal in the low non-voice band, and the signal in the high non-voice band, and the suppressed acoustic signals indicating the sounds outputted respectively from said output units of said first and second hearing aid devices include, in common, a signal in the non-voice band included in the acoustic signal.

* * * * *